US006421582B1

(12) United States Patent
Wada

(10) Patent No.: US 6,421,582 B1
(45) Date of Patent: Jul. 16, 2002

(54) PRINT SYSTEM AND A SHEET-PROCESSING DEVICE SUITABLE FOR SUCH A PRINT SYSTEM

(75) Inventor: Kenichi Wada, Takatsuki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/570,541

(22) Filed: May 12, 2000

(30) Foreign Application Priority Data

May 14, 1999 (JP) ..... 11-134130

(51) Int. Cl.[7] ..... G03G 21/02

(52) U.S. Cl. ..... 700/232; 700/235; 700/237; 271/298; 399/79; 399/80; 194/239

(58) Field of Search ..... 700/231, 232, 700/235, 237; 270/52.02; 399/1, 75, 79, 80, 81, 90; 194/239, 230, 210, 211, 247, 302; 371/298

(56) References Cited

U.S. PATENT DOCUMENTS

| | | | | | |
|---|---|---|---|---|---|
| 4,133,420 | A | * | 1/1979 | McManus | 194/241 |
| 4,308,941 | A | * | 1/1982 | Rist et al. | 194/217 |
| 5,328,170 | A | * | 7/1994 | Coombs et al. | 271/297 |
| 5,358,238 | A | * | 10/1994 | Mandel et al. | 271/298 |
| 5,435,544 | A | | 7/1995 | Mandel | |
| 5,464,200 | A | * | 11/1995 | Nakazato et al. | 270/52.02 |
| 5,525,031 | A | * | 6/1996 | Fox | 399/404 |
| 5,547,178 | A | * | 8/1996 | Costello | 270/52.02 |
| 5,619,024 | A | * | 4/1997 | Kolls | 399/1 |
| 5,697,761 | A | | 12/1997 | Morgan et al. | |
| 5,752,697 | A | * | 5/1998 | Mandel et al. | 270/58.18 |
| 6,064,838 | A | * | 5/2000 | Maruta et al. | 399/79 |

FOREIGN PATENT DOCUMENTS

| | | | |
|---|---|---|---|
| JP | 54-44523 | * | 4/1979 |
| JP | 7-49645 A | * | 2/1995 |
| JP | 7-230370 | | 8/1995 |
| JP | 8-133565 | | 5/1996 |
| JP | 9-179277 | | 7/1997 |
| JP | 2000-53314 A | * | 2/2000 |
| JP | 2001-31327 A | * | 2/2001 |

* cited by examiner

*Primary Examiner*—Christopher P. Ellis
*Assistant Examiner*—Patrick Mackey
(74) *Attorney, Agent, or Firm*—McDermott, Will & Emery

(57) ABSTRACT

When a fare is inserted, a receipt on which a password assigned to the user is printed is issued, and a sheets each bearing a printed image is housed in a storage bin or a storage box. When the password printed on the receipt is inputted, the corresponding storage bin (storage box) is shifted to a sheet outlet, thereby allowing the user to take this out. Thus, it is possible to provide a print system that is superior in the operability and allows the user to positively obtain his or her own job, and a sheet-processing device suitable for such a system.

5 Claims, 24 Drawing Sheets

Fig.4

Convenience store
** store

TEL : XXXX-XX-XXXX

2000 / 01 / 10 15 : 21

| | | |
|---|---|---|
| Print fare | 10 sheets | ¥286 |
| Total | | ¥286 |
| Consumer's tax, etc. | 5.0% | ¥14 |
| Total | | ¥300 |

Detailed account

Key releasing password is:

2734682

*Fig.20*

(Table showing relationship)

| Bin No. | Code |
|---|---|
| 01 | A····· |
| 02 | B····· |
| 03 | C····· |
| 04 | D····· |
| 05 | E····· |
| 06 | F····· |
| | G····· |
| | H····· |
| | J····· |

Maximum amount storage bin

Four jobs

PRINT SYSTEM AND A SHEET-PROCESSING DEVICE SUITABLE FOR SUCH A PRINT SYSTEM

This application is based on application No. 11-134130 filed in Japan, the contents of which is hereby incorporated by reference.

BACKGROUND OF THE INVENTION

1. Field of the Invention

The present invention relates to a print system and a sheet-processing device preferably used for the print system and, more specifically, to an image output apparatus of an automatic vending machine type and a device connected therewith for preventing prints from being taken away by others.

2. Description of the Related Art

In recent years, image output apparatuses of the automatic vending machine type, which output image data picked up by a digital camera, etc., as a printed image on a sheet of paper, have been proposed. Since such image output apparatuses are usually installed in places where a number of unspecified people come around, it is feared that an output print (a sheet bearing a printed image) might be taken away by someone other than the user before he or she knows it. Consequently, it is necessary for the user to wait for the completion of the printing process near the apparatus until he or she receives the outputted print.

For this reason, Japanese Patent Laid-Open Publication No. 9-179277 has proposed a sorter device which puts a print in a sheet-discharge bin for each order so that only the user concerned can takes the print out; thus, the sorter device of this type can prevent the print from being taking away by others.

However, the above-mentioned conventional sorter device requires a plurality of outlets and some of the outlets have to be placed at positions that are inconvenient in taking prints out. Moreover, the same number of locking mechanisms for opening and closing the outlets and means for providing a display as to which door should be opened to get a discharged print as the number of the sheet-discharge bins have to be installed. Another problem is that since the print should be bent with a comparatively small curvature when it is sorted, paper jams tend to occur.

Here, as disclosed in Japanese Patent Laid-Open Publication No. 7-230370, a mail box has been proposed in which the locking is releasing by using a password, a warning is given when a finished print has been left for a long time, while the manager is exclusively allowed to access it, and a display of any empty bin is provided. However, this system is assumed to be used in an office where the user can be specified, and is not suitable for a printer of the automatic vending machine type that is used by a number of unspecified people.

In order to solve the above-mentioned problems, the objective of the present invention is to provide a print system in which an outlet is placed at a desired position that allows easy handling and a sorting process is carried out without the need for bending a print sheet so as to prevent paper jams, and a sheet-processing device for such a print system.

SUMMARY OF THE INVENTION

In the sheet-processing device of the present invention which is connected to a printing device for printing an image on a sheet, there are provided: a plurality of storage bins installed inside an device frame, in which each of sheets classified for each job is placed; a sheet outlet formed in the device frame; a bin shifting mechanism for shifting each of the bins; an identifying means for identifying a user; and a controller for controlling the bin shifting mechanism; thus, when the user is identified by the identifying means, the bin related to the identified user is shifted to a position facing the sheet outlet.

When the user is identified in this manner, the job specified by the user is automatically carried to the sheet outlet so that the user can get his or her job smoothly without having any unnecessary confusion.

In this case, it is preferable to design the system so that the identification is made by allowing the user to key input a password assigned to the user.

Moreover, it is preferable to provide a lockable door at the sheet outlet so as to prevent tempering.

Furthermore, a bundle of sheets on the storage bin which has been shifted to the sheet outlet may be pushed toward the sheet outlet; thus, the user is allowed to pick up the sheets more easily.

Sheets discharged from the printing device are transported to the corresponding storage bins by the transporting mechanism for the respective jobs.

The bin shifting mechanism and the transporting mechanism are preferably designed so that, while either of them is in operation, the other is not allowed to operate; thus, it is possible to prevent jams beforehand.

Instead of storage bins, boxes for storing sheets may be stacked vertically, and these boxes are prepared in association with users; thus, when the user is identified, the corresponding box is shifted to the sheet outlet. In this case, the user takes out the box containing the sheets from the outlet. In this arrangement, it is possible to handle the bundle of sheets on a box basis, and consequently to simplify the process.

When a mechanism for pushing the boxes out from the outlet, or when the boxes are stacked in a tilted manner so as to allow them to slide out of the outlet by its own gravity, the take-out process of the boxes is further simplified.

In this case also, it is preferable to provide a lockable door at the sheet outlet so as to prevent unnecessary slipping of the boxes.

Since the boxes are taken away by the users, a space may be provided so as to stack boxes the number of which exceeds the number of them that can be shifted by the shifting mechanism; thus, extra boxes may be prepared.

Moreover, in order to easily insert the bundle of sheets in the box, it is preferable to transport each sheet in a slightly offset manner in the transport direction.

In the above-mentioned arrangement, the boxes are stacked in an up and down direction; however, the boxes may be aligned laterally and a plurality of laterally aligned boxes may be shifted as a whole. In this arrangement, sheets are inserted into the boxes from above, and housing units for housing the respective boxes may be prepared so as to house each box containing the bundle of sheets in a predetermined position of each of the housing units.

In this case, a box corresponding to the identified user that is housed in the housing unit is shifted longitudinally to the outlet position, and the box is taken out of the outlet. Here, the application of a mechanism for pushing the box out of the outlet allows the box to be taken out more easily.

Moreover, in the image output apparatus of this type, a considerable period of time is required for printing an image, with the result that the job might be left for a long time without being taken out because of the fact that the user becomes impatient to wait, or fails to come and pick up the job at the specified time.

Taking this situation into consideration, a sheet housing section with a large capacity may be prepared separately from the storage bins, and if the job has not been taken out for a period exceeding a predetermined time, the job may be housed in this sheet housing section.

With respect to the jobs housed in the sheet housing section, they may be stacked in an offset manner for each of the jobs; thus, since the take-out process is carried out on a job basis, it becomes possible to omit the sorting process at the time of housing.

With respect to the jobs housed in the sheet housing section, it is preferable to make an arrangement so that only a manager is allowed to access them.

In the case when no empty storage bin exists, the latest job may be directly transported to the sheet housing section, or the job which has been housed in a storage bin for the longest time is housed in the sheet housing section so as to prepare an empty storage bin in which the latest job can be housed.

It is preferable to install a memory which stores coded information corresponding to respective jobs in association with the numbers of the respective bins. In the case when the job is shifted from the storage bin to the sheet housing section as described above, the number of the bin corresponding to the job is changed to the number of the corresponding sheet housing section.

Moreover, in the case where a locking means for inhibiting the take-out of a job is installed in the sheet housing section, when, upon release of the locking means, the job has been taken out, the corresponding coded information in the memory is deleted.

The present invention also includes a print system as described below: This print system has an arrangement in which there are installed a print unit for making a print on a sheet, a first control means for allowing the print unit to carry out a printing process upon receipt of a predetermined fare, a second control means for allowing a printed sheet to be taken out when a predetermined piece of coded information has been inputted, and a receipt output device for outputting a receipt on which the fare and the predetermined coded information are printed.

In this print system, the receipt on which the predetermined coded information has been printed is issued, and the user can take out the job by inputting the predetermined coded information printed on the receipt. It is not necessary for the user to memorize the predetermined coded information such as a password code assigned to the user, and the user can readily take out the job as long as he or she has the receipt.

In this print system, the above-mentioned various types of the sheet-processing devices may be installed so that the job specified by the user can be positively shifted to the sheet outlet by maintaining the coded information in association with the numbers of the sheet housing boxes and the storage bins.

In this print system, a third control means, which, in the case when a job has not been taken out after a lapse of a predetermined time, prevents the job from being taken out, is installed so that the job management is properly carried out. With respect to the job that has been inhibited, a display explaining this fact is given to the user, and allows the user to contact the manager. The manager, informed of the fact, can release the locked state and pass the job to the user.

BRIEF DESCRIPTION OF THE DRAWINGS

The present invention will become readily understood from the following description of preferred embodiments thereof made with reference to the accompanying drawings, in which like parts are designated by like reference numeral and in which:

FIG. 4 is a plan view showing one example of a receipt that is issued;

FIG. 20 is a table showing the relationship between bin numbers and information codes;

DETAILED DESCRIPTIONS OF THE INVENTION

Figure 1:
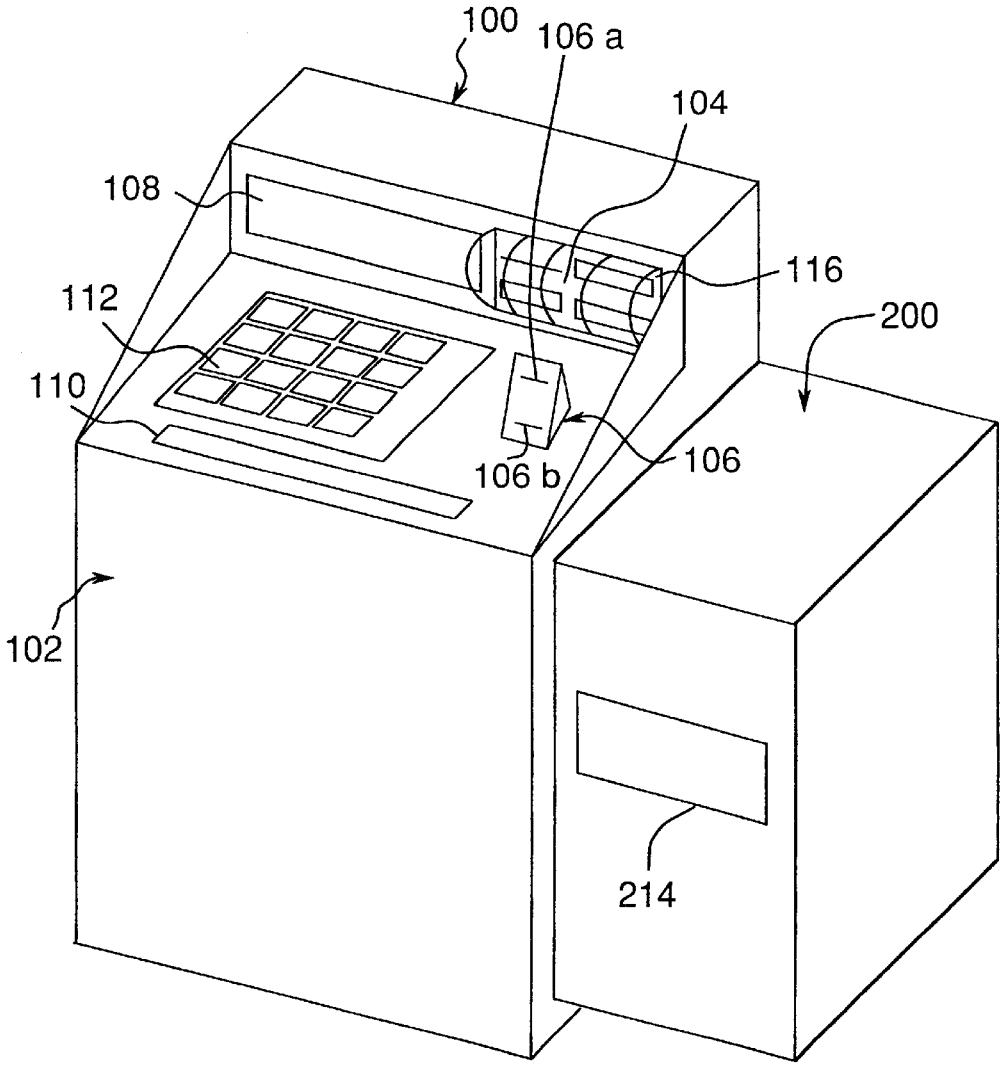
FIG. 1 is a perspective view showing an entire structure of an image output apparatus in accordance with the present invention.

As illustrated in FIG. 1, an image output apparatus 100 is provided with a media loading section 104 formed on the upper portion of a box shaped main body 102 equipped with a silver salt printer inside thereof, a fare insertion section 106, a panel 108, a key board 110 and a monitor 112. Moreover, a sheet-processing device 200 is installed on the side portion of the main body 102 so as to allow a print processed by the silver salt printer to be taken out on. demand.

The media loading section 104 is placed on the upper portion of the image output apparatus 100 and is used so as to load an image recording medium bearing a desired image to be printed. A cover 116 is attached to the media loading section 104 so as to protect it from dusts; however, not the cover 116 but a dust-proofing shutter may be attached to each of the loading inlets.

The fare insertion section 106 is provided with an insertion opening 106*a* through which a predetermined fare is inserted into the image output apparatus 100*a* and a receipt output section 106*b*.

The panel 108 is placed in the vicinity of the media loading section 104, and forms a display section for displaying kinds of the image recording media to be loaded. In the case when a touch switch is placed so as to select an image recording medium as will be described later, the panel 108 also serves as an operation section. Any one of four kinds of image recording media (smart media, compact flash, optical disks and floppy disks) may be loaded into the media loading section 104 of the image output apparatus 100 of the present invention. Any of these image data is compressed and stored in the JPEG format, and subjected to a JPEG developing process inside the image output apparatus 100. Here, a detailed explanation of the media loading section 104 and the panel 108 will be given later by reference to FIG. 2.

The key board 110 is installed so as to allow the user to input various operation instructions through it. The key board 110 includes a key for selecting which image is to be printed, a key for starting a printing operation, etc., and also includes a key exclusively used by a service person for maintaining the image output apparatus 100 and a forced discharge key for printed paper (neither of which are shown).

The monitor 112 displays an instruction for operations given through the key board 110 and an image to be printed. The monitor 112 is further provided with a touch panel on its surface, to which an ID code is inputted; thus, it is. possible to give instructions to the image-input apparatus 100.

A print discharge outlet 214 at front of the sheet-processing device 200 is provided for enabling the user to remove from the sheet-processing device 200 prints that have been discharged from the image output apparatus 100.

Figure 2:
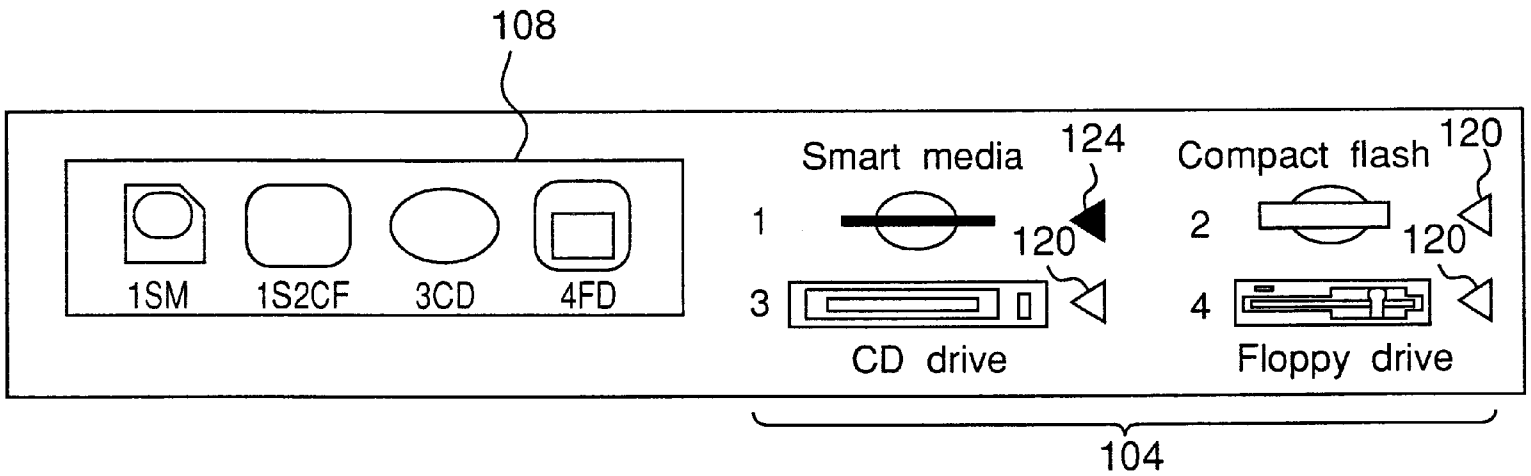
FIG. 2 is a front view showing the media loading section and the panel of the image output apparatus.

FIG. 2 shows the media loading section 104 and the panel 108 in more detail. As described earlier, the image output apparatus 100 (FIG. 1) in the present embodiment is allowed to load the four kinds of image recording media. The media loading section 104 is provided with loading openings through which these image recording media are loaded, in a manner so as to correspond to the respective numbers. The media loading section 104 is further provided with display sections 120 and 124 that respectively show where to attach the selected image recording medium. The panel 108 schematically shows the shapes of the four kinds of image recording media corresponding to the respective numbers. Symbols consisting of figures and characters are shown below the respective schematic drawings of the image recording media on the panel 108. The figures on the left of the respective symbols correspond to the numbers of the loading openings of the media loading section 104. A touch switch is placed on the panel 108 so that it is possible to specify which kind of image recording media is to be used.

Next, referring again to FIG. 1, the following description will discuss the basic operation of the image output apparatus 100. The image output apparatus 100 is activated when a power switch (not shown) is turned on by the manager, the user, etc. of the image output apparatus 100. First, the user inserts a predetermined fare through the fare insertion section 106, and selects one of the image recording media to be used through the panel 108. The user compares the kind of the image recording medium with the schematic drawings or the abbreviated names on the panel 108 so as to select the image recording medium to be used. The selection may be made by using the touch switch that is placed on the panel 108, or may be made by inputting the corresponding number of the image recording medium to be used by utilizing the key board. 110 (FIG. 1). Alternatively, the selection may be made by using the touch panel on the monitor 112.

When the user selects one of the image recording media, the corresponding one of the four display sections 120, 124 (FIG. 2) lights up. In the example of FIG. 2, the display section 124 corresponding to the smart media lights up. The user inserts the recording media (a smart medium, in this example) into the inlet that is indicated by the display section 124 (FIG. 2) that has lighted up. The media loading section 104 and the panel 108 are arranged as described above so that the user can visually confirm the image recording medium to be used so as not to erroneously insert the image recording medium into another inlet. Then, following the display of the monitor 112, the user gives various operational instructions (such as instructions for specifying an image on the monitor 112) to the image output apparatus 100 through the touch panels of the key board 110 and the monitor 112.

The image output apparatus 100 detects the inclination of a linear portion of a subject displayed on the monitor 112 based upon the instructions from the user. A detailed explanation of the detection of the inclination will be given later. The user confirms the detection of the inclination and if it is not correct, allows the image output apparatus 100 to again carry out the inclination detection. When the inclination of the linear portion of the subject is correctly detected, the user allows the image output apparatus 100 to correct the inclination by rotating the image; thus the image is displayed. When the user has judged that the inclination of the subject has been corrected, the user gives an instruction so as to allow the image output apparatus 100 to start a printing process. Then, the image output apparatus 100, which is equipped with a printer for printing normal photographs inside thereof, starts the printing process in accordance with the instruction for the start of the printing process. The image output apparatus 100 discharges a printed paper, etc., onto the sheet-processing device 200, thereby completing the operation. The printed paper, which has been discharged, and the loaded image recording medium are taken out by the user. Here, even in the case when the inclination of the subject has been accurately corrected, if the user wants not to print the data, but to store it in a recording medium, the data is stored in the recording medium desired by the user.

Figure 3:
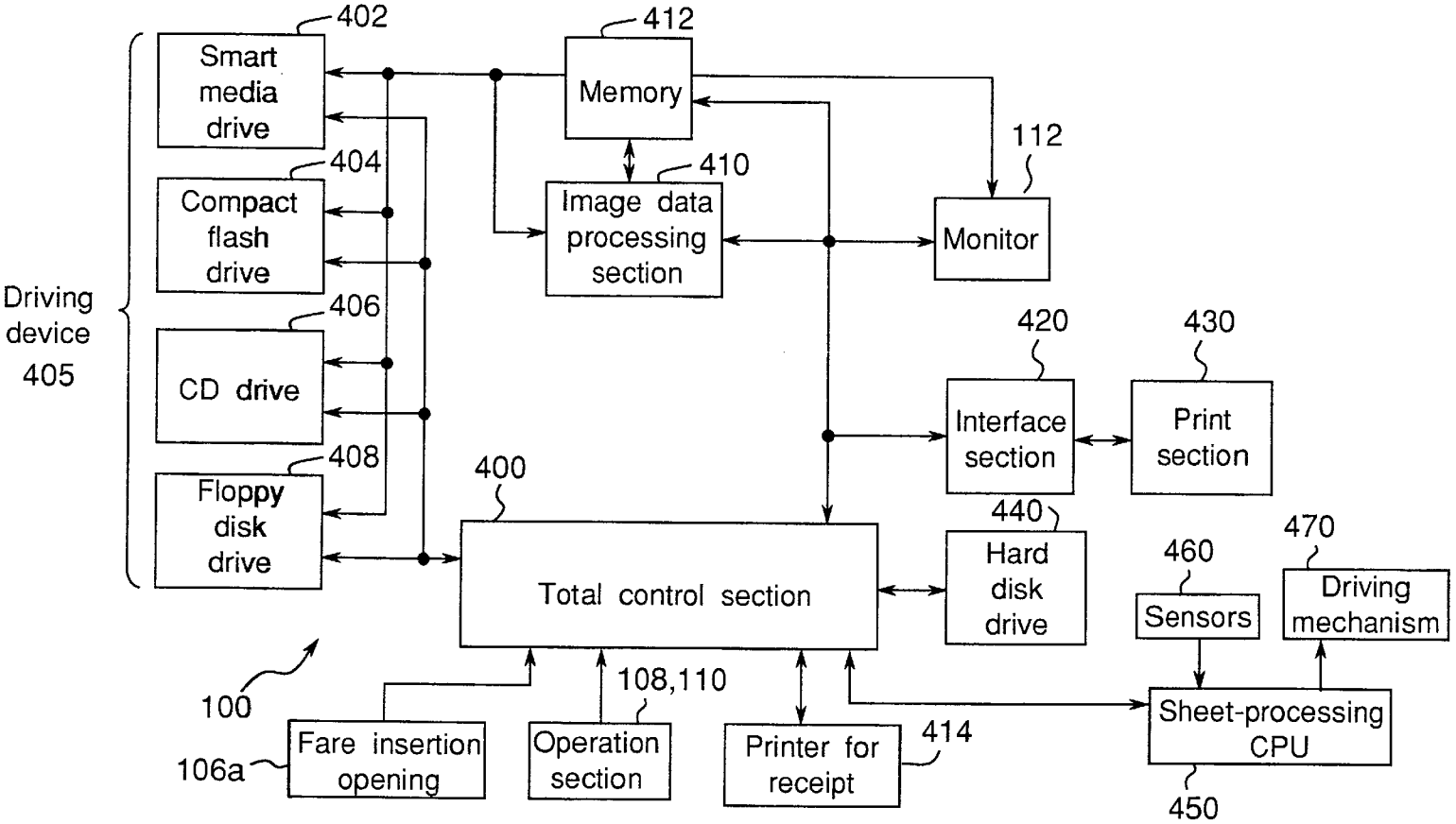
FIG. 3 is a block circuit diagram showing a control system of the image output apparatus.

Next, an explanation will be given of the inner construction of the image output apparatus 100 and the processes carried out therein. FIG. 3 is a block diagram that shows the inner construction of the image output apparatus 100. The image output apparatus 100 is provided with operation sections 108 and 110, the fare insertion section 106 and the monitor 112. The image output apparatus 100 is further provided with a total control section 400, a driving device 405 provided in accordance with the usable image recording media, an image-data processing section 410, a memory 412, a receipt-use printer 414, an interface section 420, a print section 430, a hard disk drive 440, a sorter (which will be described later) controlling CPU 450 inside the sheet-processing device 200, sensors 460 and a driving mechanism 470.

Prior to explanations on the inner processes of the image output apparatus 100, an explanation will be given of functions of the respective inner constituent elements. Here, the explanations on the operation sections 108 and 110, the fare insertion section 106, the loading inlet display sections 120, 124 and the monitor 112, which have been made by reference to FIGS. 1 and 2, are omitted. The operation section 108 corresponds to a touch switch of the panel 108 (FIG. 2), the operation section 110 corresponds to a key board 110 (FIG. 1), and the loading inlet display sections 210, 220 correspond to the loading inlet display section (FIG. 2) for the image recording media.

The total control section 400 controls the operations of the entire constituent elements of the image output apparatus 100. More specifically, the total control section 400 carries out the following operations: confirmation of a fare inserted into the fare insertion opening 106*a* (FIG. 1); receipt of instructions from the operation sections 108, 110; lighting operations for the loading inlet display sections 120, 124; transmission of the readout instruction of image data to the driving device 405 and receipt of the image data; transmission of the image data processing instructions to the image data processing section 410; transmissions of instructions for the image data storage and the image data readout to the memory 412; transmission of an instruction for display to the monitor 112; and transmission of image data to the print section 430 and control of the operations thereof. Such operations are carried out in accordance with computer programs stored in the hard disk drive 440.

The driving device 405 includes a smart media drive 402, a compact flash drive 404, an optical disk drive 406 and a floppy disk drive 408. Either of the drives in the driving device 405 reads out image data from the image recording medium upon receipt of an instruction from the total control section 400, and outputs the image data thus read to the total control section 400 or the image-data processing section 410. Here, any driving device other than the above-mentioned driving devices may be used, as long as the driving device carries out such processes as described above.

In accordance with the instruction from the total control section 400, the image data processing section 410 processes image data received from the memory 412 or the driving device 405 so as to provide a display and a print.

The memory 412 stores the image data received from the driving device 405, and also stores image data processed in the image-data processing section 410. Upon receipt of an instruction from the total control section 400, the memory 412 reads the stored image data, and sends it to the monitor 112 and further to the print section 430 through the interface 420.

The receipt-use printer 414 prints a receipt, for example, as shown in FIG. 4, and outputs this. This receipt features that a password number (in the lowest row) for the user is printed thereon.

The interface 420 allows bi-directional communications between the total control section 400 and the print section 430. One example of data that is transmitted through the interface section 420 includes image data, etc. transmitted from the memory 412 to the print section 430. Another example of the data transmitted through the interface section 420 is print status data indicating the execution state of a printing process to the total control section 400, such as a notification of print failure released from the print section 430.

The print section 430 receives the image data through the interface section 420, and makes a print on printing paper based upon the image data. The print section 430 is constituted by a known printer mechanism such as a laser printer, a silver salt printer, etc.

The hard disk drive 440 stores a sequence of processes required for the total control section 400 to control the operations of the image output apparatus 100 as computer programs. One of the computer programs is a computer program which carries out the inclination detecting process and the inclination correcting process on the subject, as will be explained later by reference to FIGS. 5, 6 and 9. The recording medium for storing the programs is not necessarily limited to a hard disk, and other media such as ROM, etc. may be used as long as it can store the computer programs.

The sheet-processing CPU 450 is a CPU for driving and controlling various mechanisms (which will be described later) inside the sheet-processing device 200, and based upon control instructions from the total control section 400, it uses output signals of the various sensors 460 as input signals, and outputs driving signals to the various driving mechanisms 470 so as to drive the various driving mechanisms.

Figure 5:
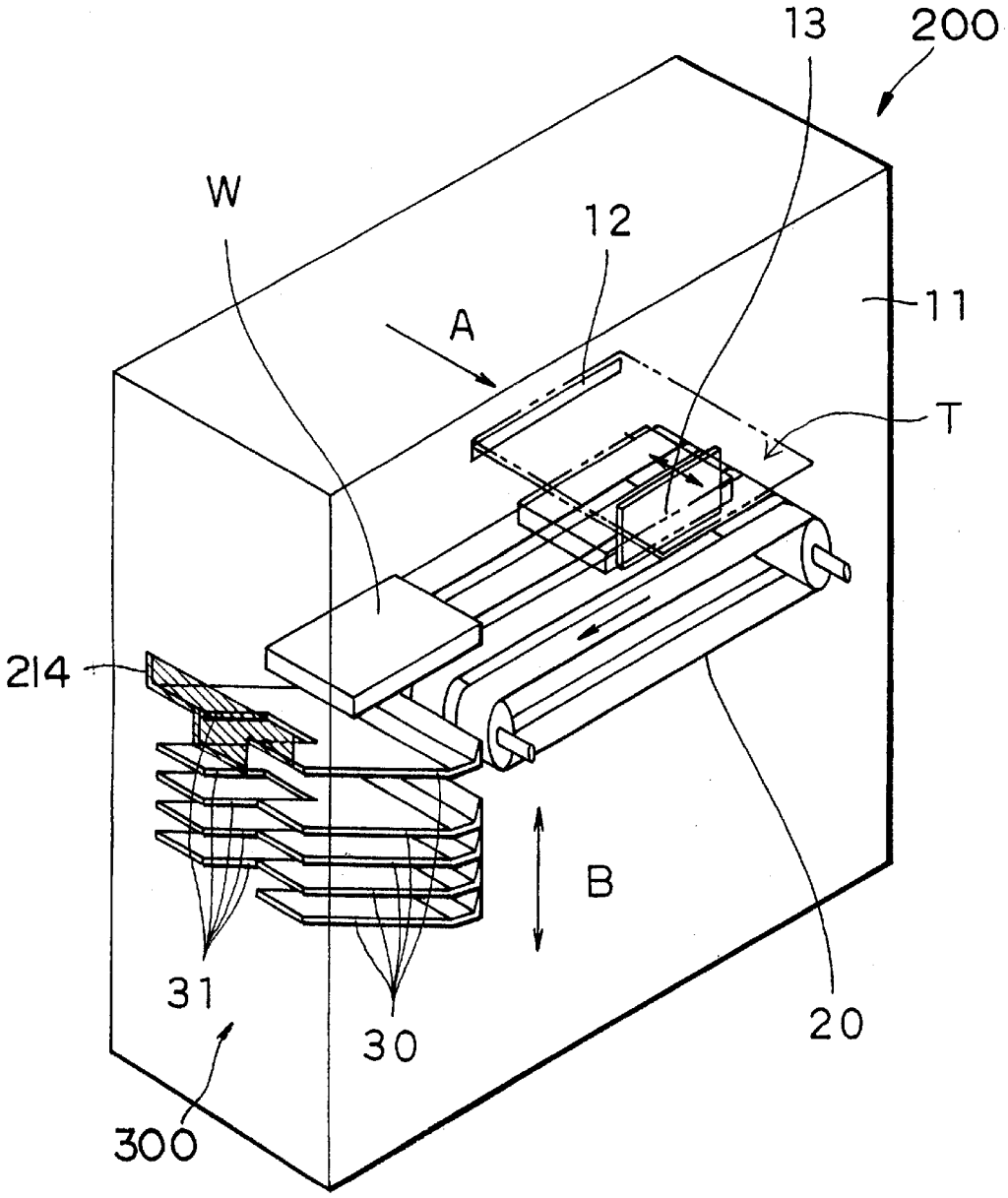
FIG. 5 is a schematic perspective view showing a construction of a preferred embodiment of a sheet-processing device in accordance with the present invention.

Referring to FIGS. 5 through 8, the following description will discuss a preferred embodiment of a sheet-processing device in accordance with the present invention. FIG. 5 is a schematic perspective view that shows the construction of the sheet-processing device of the present embodiment. In the sheet-processing device 200 of the present embodiment, a paper outlet 12 is formed in a side wall of the device frame 11 so that paper W, sent from the image output apparatus, is discharged in the direction of arrow A. Moreover, a conveyor belt (transporting means) 20, which is driven by a motor (not shown), is installed in the device frame 11 with its starting end located on the front lower. side of the paper outlet 12, and a leading edge regulating member (conforming means) 13 which comes into contact with the leading edge of the paper W is placed on the starting end of the transporting belt 20 so that a trap section (paper discharge section) T for maintaining a plurality of paper W is formed.

Moreover, a sorter section 300 is installed in front of the conveyor belt 20 in the transporting direction, and in the sorter section 300, five stages of storage bins 30 are aligned in an up and down direction; thus, the five stages of storage bins 30 are allowed to shift in an up and down direction (in the direction of arrow B) by a shifting mechanism (not shown). Here, a notch 31 having a square shape is formed in the leading edge of each of the storage bins 30. Furthermore, an outlet (outlet section) 214 is formed in a wall face of the device frame 11 in front of the storage bins 30.

FIG. 5 exemplifies a case in which sheets of paper W, discharged sheet by sheet, are collected into a bundle in the trap section T, and this is outputted into the storage bin 30 on the uppermost stage by the conveyor belt 20.

Figure 6:
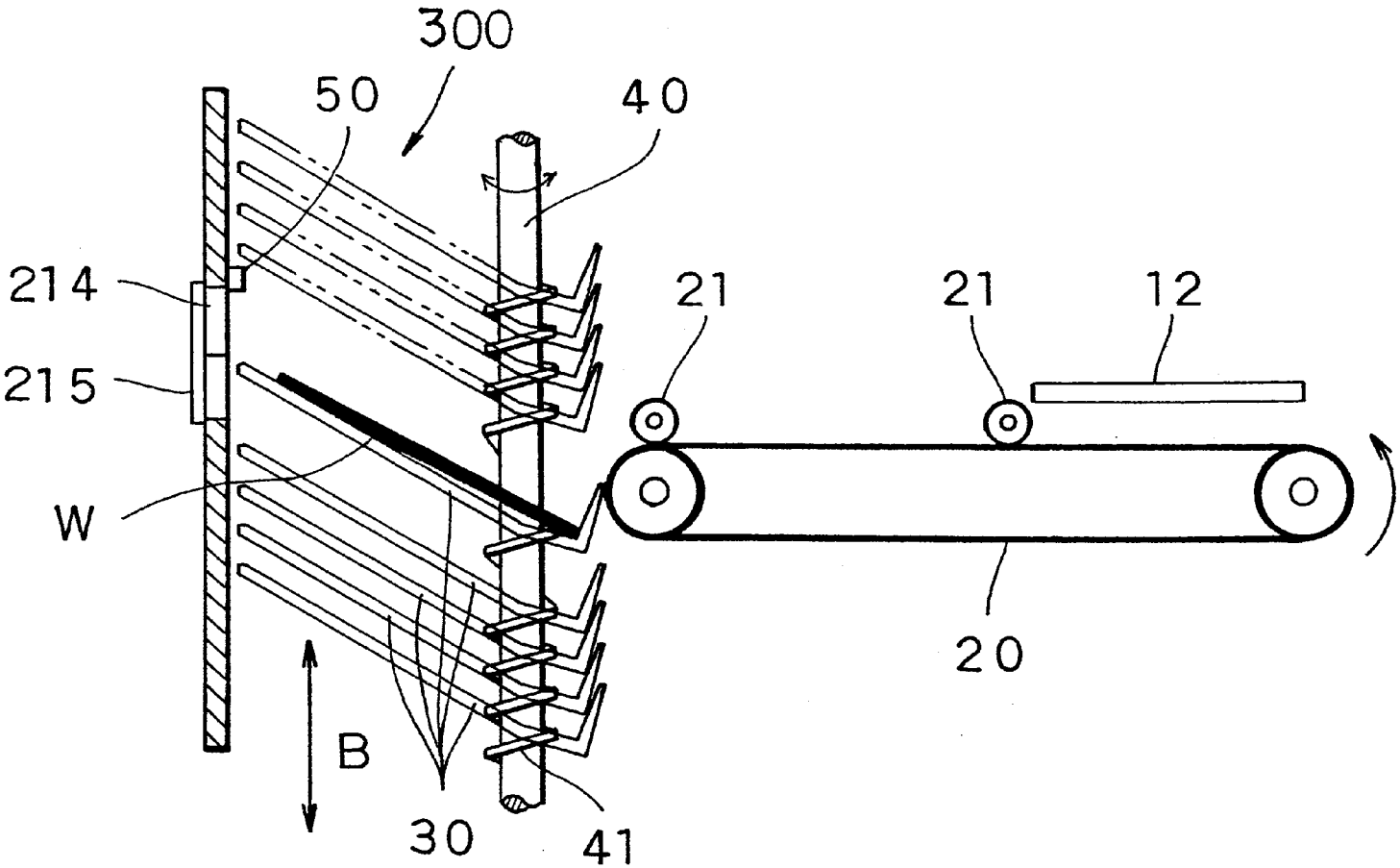
FIG. 6 is a schematic diagram showing a specific structure of the above-mentioned embodiment.

FIG. 6 shows a specific construction of the sheet-processing device of the present embodiment. In FIG. 6, pressing rollers 21 are placed on the conveyor belt 20 in a manner so as to have a gap between them with respect to the transporting direction; thus, the pressing rollers 21 press the bundle of sheets W onto the conveyor belt 20 so that the sheets of paper W as a bundle are transported.

Inside the device frame 11, a rod 40 is installed in a manner so as to stick upward at a position that causes no intervention with the discharging of the paper W in front of the conveyor belt 20 in the transporting direction, and the rod 40 is provided with a spiral section 41. The spiral section 41 is designed so that a pitch in the center portion is greater than pitches in other portions, and the spiral section 41 is connected to one portion of the five stages of the storage bins 30; thus, the rod 40 is forwardly or reversely rotated by the motor (not shown) so that the storage bins 30 are shifted in the direction of arrow B. The rod 40 and the spiral section 41 form a shifting mechanism for shifting the storage bins 30. Moreover, a door 215 is attached to the outlet 214 in the device frame 11, and a sensor 50 for the paper W is installed in the vicinity of the outlet 214.

For example, when a sheet of processed paper W is discharged from the main body side, that is, the image output apparatus, the sheet of paper W is discharged on the conveyor belt 20 through the paper outlet 12. Here, the leading edge regulating member 13 (FIG. 5), which can shift in the width direction of the conveyor belt 20 in accordance with the size of paper, is installed on the conveyor belt 20, with the result that the leading edge of the discharged paper W comes into contact with the leading edge regulating member 13, and sorted and stopped; thus, in the same manner, a plurality of sheets of processed paper W are stacked sheet by sheet on the trap section T on the conveyor belt 20, and maintained therein. It is preferable to allow the leading edge regulating member 13 to shift in the paper discharging direction A, if necessary; thus, its arranging property is further improved. After one job has been completed, the conveyor belt 20 is shifted in the direction of arrow, with the result that the sheets of paper W forming a stack are transported to the sorter 300 and put into one of the storage bins 30.

This arrangement allows the stored paper W to be taken out from the storage bin 30 without being intervened by the next job. In other words, in the case of a conventional sheet-processing device, the bin is not allowed to shift up or down until all the discharged sheets of paper have been put into the bin, and has to be in a stand-by state until the completion of the job currently being carried out. In contrast, in the case of the present embodiment, the paper W as one stack is transported into the storage bin 30 so that any desired one of the storage bins 30 can be shifted up or down so that the stored paper W can be taken out, except the case in which the paper W is being transported into the storage bin 30.

In the sorter section 300 having a construction in which the storage bins 30 are allowed to shift in an up and down direction, when a storage bin 30 comes to a position facing the rear end of the conveyor belt 20, that is, a position where the transported paper W is received, a gap between the storage bin 30 and the upper and lower storage bins 30 is set to be wider than the gap at other positions. This arrangement is made because the pitches of the spiral section 41 that shifts the storage bins 30 up and down are different from each other, and in the device of the present embodiment, each time the spiral section 41 rotates once, the storage bin 30 is allowed to shift a predetermined distance. In the present embodiment, the position at which the storage bin 30 receives the transported paper W and the level of the outlet 214 are set in virtually the same level; therefore, immediately after the paper discharge, the paper W can be taken out. However, in such a construction, since someone might take the paper W out, it is preferable to place a door 215 with a lock in front of the outlet 14.

The sensor (printed subject detection means) 50 optically detects whether or not paper W exists on a storage bin 30 that is located at the position of the outlet 14, more specifically, whether or not paper W exists at the notch 31 of the storage bin 30.

Figure 7:
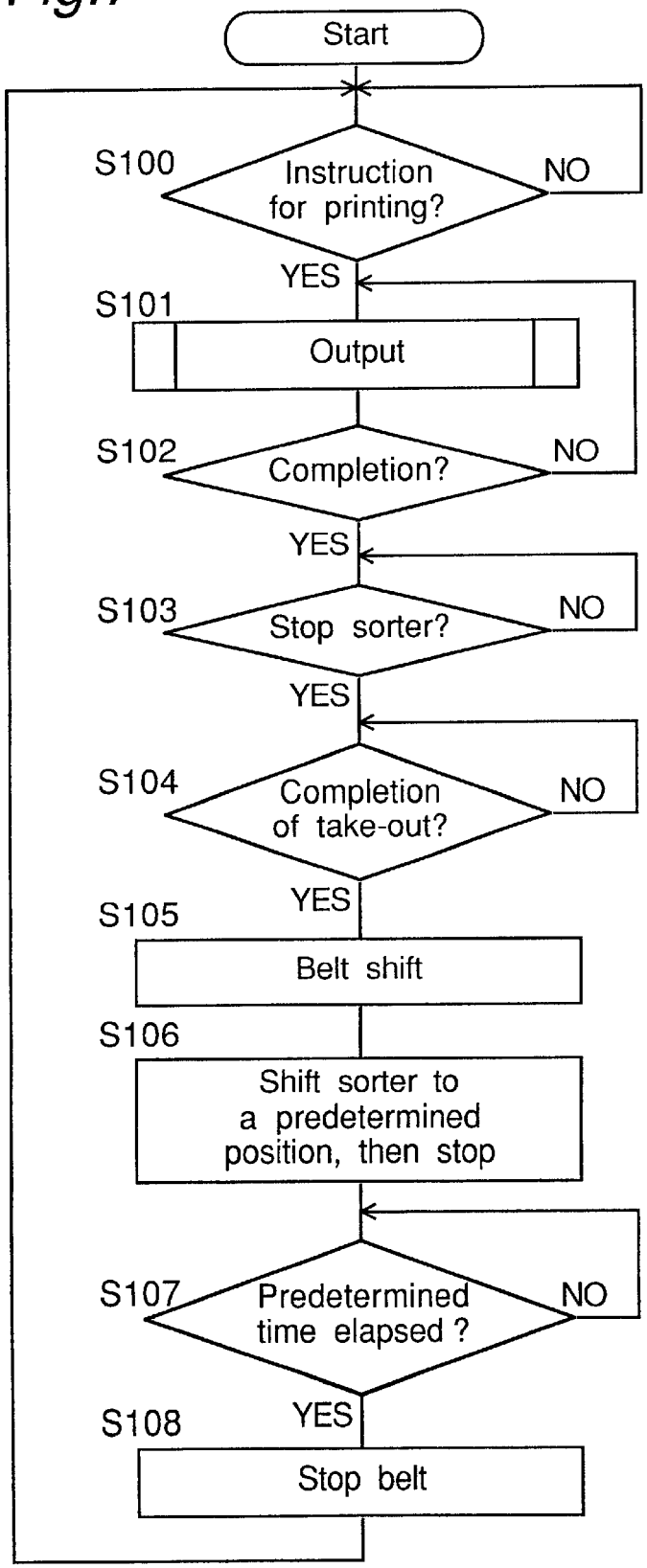
FIG. 7 is a flowchart indicating a storage process for sheets of paper in the above-mentioned embodiment.

Next, referring to a flowchart in FIG. 7, an explanation will be given of a controlling operation of discharged paper sorting processes. This controlling operation is carried out by a CPU 450 of the sheet-processing device 200; however, this operation may be carried out by the CPU on the main body (for example, the image output apparatus) side. When the sequence of processes is started, the device is maintained in a stand-by state (step S100) waiting for a print instruction by the user, and upon receipt of the print instruction, a printing process is carried out on a print subject in a printing section (not shown) on the main body side, and printed sheets of paper W are outputted from the paper outlet 12 one sheet by one sheet (step S101).

Upon completion of a predetermined job (step S102), in the case when any one of the storage bins 30 is being shifted so as to take out other printed paper W, the device is maintained in the stand-by state (step S103), and when the storage bin 30 is stopped, a judgment is made as to whether or not the take-out of other printed paper W has been completed, by detecting whether or not the paper W exists on the storage bin 30 (step S104).

Upon completion of the take-out of other printed paper W, the conveyor belt 20 is activated, and the sheets of paper W, maintained as a stack on the conveyor belt 20, are shifted toward the sorter section 200 (step S105), while an empty storage bin 30 is shifted to a position facing the conveyor belt 20, and then stopped (step S106). When, after a lapse of a predetermined time since the activation of the conveyor belt 20, the transported sheets of paper W as a stack are put into the storage bin 30, the conveyor belt 20 is stopped (step S107, S108).

Figure 8:
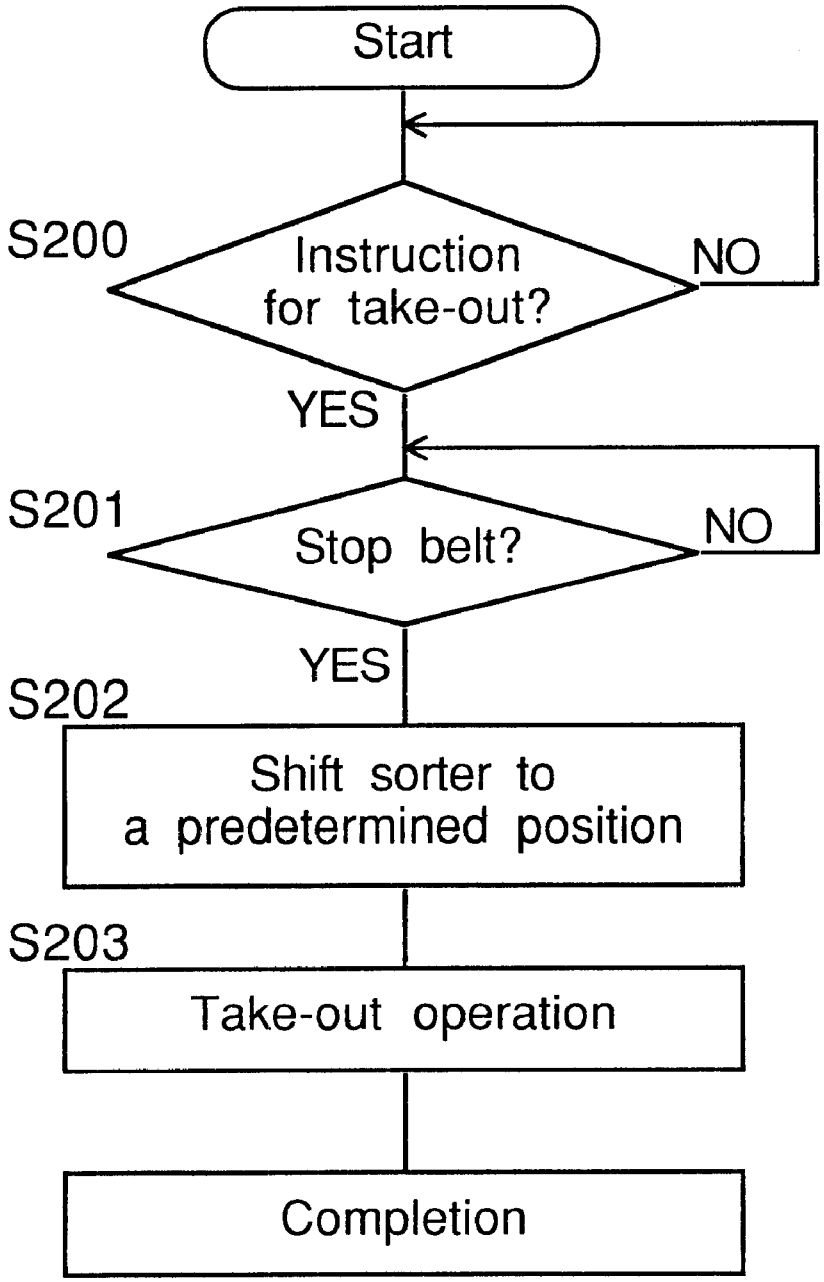
FIG. 8 is a flowchart indicating a take-out process of sheets of paper in the above-mentioned embodiment.

Next, referring to a flowchart in FIG. 8, an explanation will be given of a controlling operation of a sequence of take-out processes. When the sequence of processes is started, the device is maintained in a stand-by state waiting for a take-out instruction by the user (step S200), and upon receipt of the instruction, in the case when the conveyor belt 20 is being operated so as to put other printed paper W in a predetermined storage bin 30, the device is maintained in the stand-by state waiting for the stoppage of this operation (step S201). When the conveyor belt 20 is stopped, the storage bin 30 maintaining the paper W to be taken out is shifted to the level of the outlet 14 by the shifting mechanism (step S202), and the door 15 is opened by releasing the lock, thereby allowing the user to take out the specified printed subject from the outlet 14.

Moreover, an explanation will be briefly given of a storing process in which the printed paper W, specified by the user, is stored in a storage bin 30 and a take-out process in which the paper W is taken out of the storage bin 30. When an instruction for printing is given by the user, a password is first set. In other words, when the user gives an instruction for printing, a password including numbers and characters is generated by using random numbers, etc., and this is stored in the memory 412 (FIG. 3), and is also printed on a receipt. (see FIG. 4), which is externally outputted from the receipt output section 106b of the image output apparatus.

The password thus generated, the current time and the status (in-use/empty) of the storage bin 30 are written in the memory 412, and at this time, the address of the memory 412 corresponds to the storage bin 30 so that an empty bin is selected based upon the contents of the memory 412, and the generated password is written in and a flag indicating "in-use" is placed. When the password printed on the receipt is inputted by the user in order to take out the printed sheets of paper W, this is compared with the contents of the memory, and if both of these are coincident with each other, the corresponding storage bin 30 is shifted to the outlet 14, thereby allowing the user to take out the printed paper W; thus, the contents of the memory is cleared.

Therefore, the following effects are obtained by the present embodiment.

1. It is possible to set the outlet at a desired position providing easy handling, and also to provide processes at the same position.

2. It is possible to take out paper W even in the middle of an output process for another job.

3. It is not necessary to provide processes, such as locking and displaying.

4. It is possible to arrange sheets of paper in the trap section T.

5. It is possible to carry out storage corresponding to a plurality of jobs in the trap section T.

6. It is not necessary to stop the device even in the case when jobs exceeding the number of storage bins are inputted.

Figure 9:
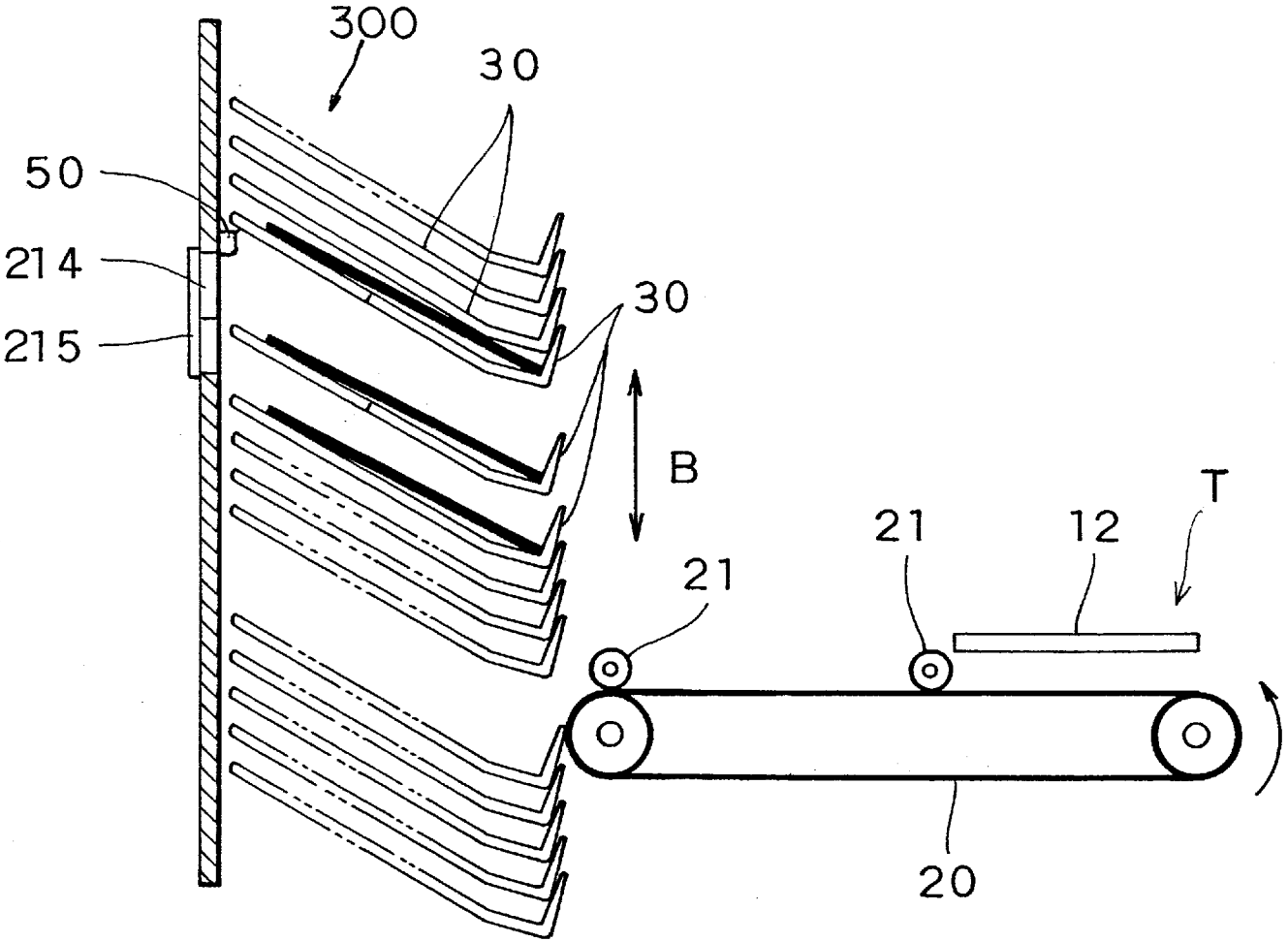
FIG. 9 is a schematic diagram showing a second embodiment.

FIG. 9 shows the second embodiment of the sheet-processing device of the present invention. In this Figure, the same reference numbers indicate the same members in FIG. 6. In the present embodiment, the level of the outlet 214 is set in a level different from the level of the rear end of the conveyor belt 20. In the sheet-processing device of the present embodiment, it is not necessary to. provide a door with a lock at the door 215 of the outlet 214. Therefore, FIG. 9 shows a state in which, among the five stages of storage bins 30, paper W in the storage bin 30 on the second stage from below can be taken out.

In such a construction, it is not possible to take out paper W unless the position of the storage bin 30 is shifted to a position facing the outlet 214 by using a specific operation such as an entry of a password, etc. It is of course preferable to install the door 215 from the viewpoint of dust protection and security; however, it is not necessary to provide a locking mechanism.

Here, in order to improve the arranging property in the depth direction (direction of arrow C in FIG. 5) of paper W in the above-mentioned two embodiments, another arrangement may be proposed in which: a regulating member, which comes into contact with the edge portion in the depth direction of paper, is placed, and a conforming member sticking out between a plurality of belts constituting the conveyor belt 20 is shifted so that the conformity in the direction of arrow C may be made. Moreover, the arrangement may be made not by shifting the regulating member, but by placing a fixed contact member and pressing roller members corresponding to the sizes of paper and reversely rotating the belt continuously or intermittently; thus, it is possible to make a proper arrangement.

In the case when the transport distance of paper from the trap section T for forming a stack of sheets of paper is set two times as long as the size of the paper, even if the five storage bins 30 are full, the sixth jobs and thereafter, may be temporarily held on the transport path. However, in this case, when any paper related to the sixth job or thereafter is taken out, at least one of the five storage bins 30 has to be emptied. In order to solve this problem, the number of the storage bins 30 may be increased, or a signal may be given so as to urge the user to take out the paper of the job which has not been taken away even after a lapse of a predetermined time so that the subsequent (manual or automatic) take-out process is executed.

Figure 10A:
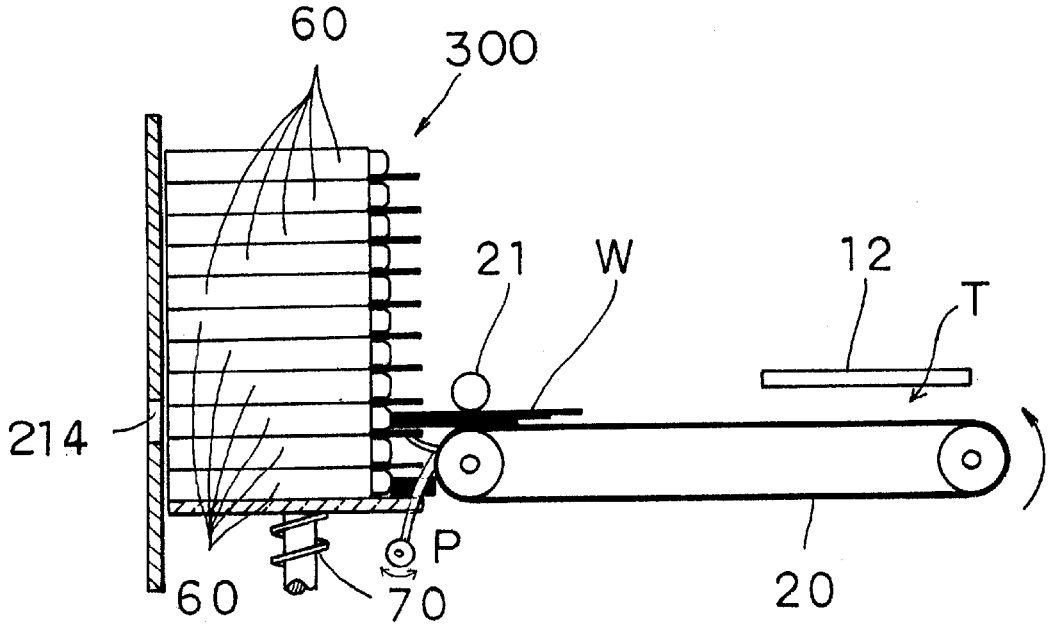
FIGS. 10A and 10B show schematic diagrams showing third and fourth embodiments, respectively.
Figure 10B:
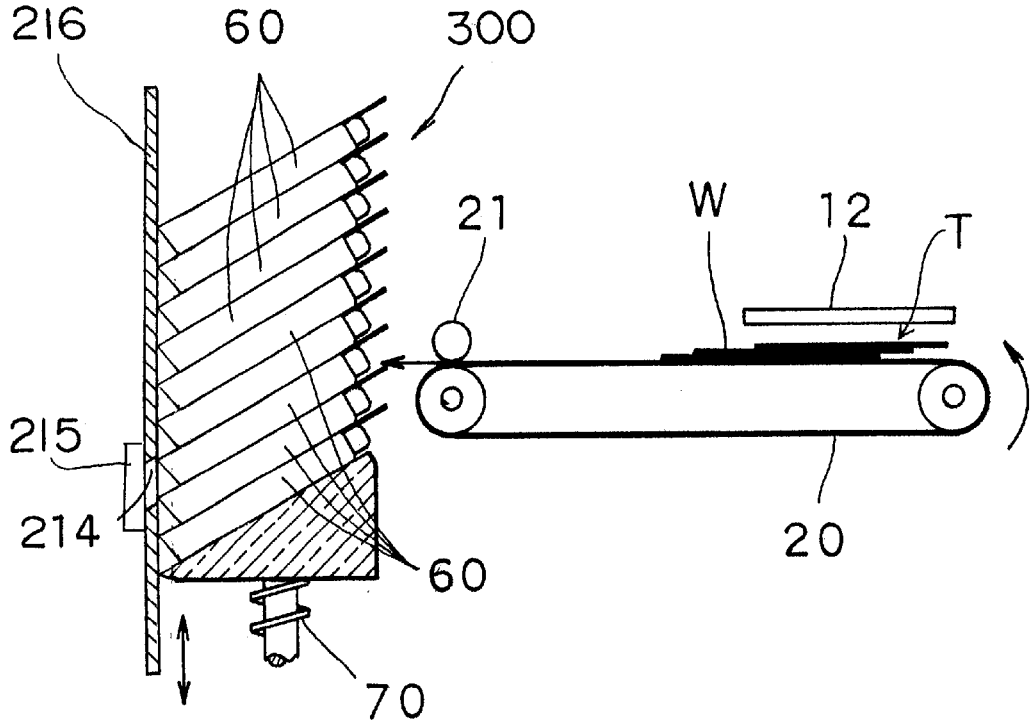

FIGS. 10A and 10B show the third and fourth embodiments of the sheet-processing device of the present invention. In these Figures, the same reference numbers indicate the same members or corresponding members in FIG. 6. In these embodiments, the sorter section 300 is constituted by a plurality of packaging boxes 60, each of which has an opening in an edge portion on one side. As illustrated in FIG. 10A, in the third embodiment, the packaging boxes are stacked in an up and down direction so as to be directed in a horizontal direction. As illustrated in FIG. 10B, in the fourth embodiment, the packaging boxes 60 are stacked in an up and down direction so as to be directed in a diagonal direction. In either of the cases, the packaging boxes 60 are allowed to shift in an up and down direction by a shifting mechanism 70 made of a spiral rod that is forwardly or reversely rotated.

Since the controlling operation of the discharged-paper sorting processes is virtually the same as the first and second embodiments, the detailed explanation thereof is omitted. Here, the sheets of paper W stacked in the trap section T may be transported and put into the packaging box 60; however, an arrangement may be made in which the conveyor belt 20 is driven for a predetermined time for each of the discharges of paper W from the main body so that the sheets of paper W are stacked in a slightly offset state in the transporting direction; thus, it becomes possible to easily put the sheets of paper W into the packaging box 60. In this case, the distance of the transport path needs to be set greater than the paper length in the case of the greatest number of sheets that can be processed in one job (paper length+amount of shifts× greatest number of sheets). The amount of shifts of the paper W may be changed in accordance with the number of sheets for one job. Moreover, when the packaging box 60 becomes nearly full of sheets, it is hard to put more paper W into the packaging box 60; therefore, the amount of shifts may be first set narrower, and then set wider so as to maintain a predetermined distance at the latter processes.

Moreover, in the embodiment as illustrated in FIG. 10A, the paper W is transported to the packaging box 60 in the same level as the transport belt 20, and the packaging box 60 is taken out from the outlet 14. The shifting mechanism 70 has a shift distance corresponding to five stages (five boxes) in an up and down direction. Normally, in the shifting mechanism 70, the packaging box 60 at the lowermost stage is positioned in the same level as the transport and take-out position, the paper W is transported by the conveyor belt 20 and put into the packaging box 60 at the lowermost stage, and the eject lever P is rotated about an axis in response to a specific operation such as an entry of a password, etc., to push the packaging box 60 at the lowermost stage through the outlet 214, thereby allowing the user to receive the paper W packed in the box. When the packaging box 60 at the lowermost stage is pushed out, the packaging box 60 located above this is allowed to drop; therefore, the shifting mechanism 70 is maintained at the highest position.

In the case when a packing process for the next job is carried out prior to the take-out process after the transportation of the paper W into the packaging box 60, the shifting mechanism 70 is lowered by one stage where the packing process is carried out, and this process is repeated to the fifth stage. Then, after a specific operation such as an entry a password, etc., any one of the packaging boxes 60 in the five stages, related to the operation, is recognized, and the shifting mechanism 70 shifts the packaging box 60 to the level of the transport and take-out position so that the corresponding packaging box 60 is taken out by the pushing operation of an eject mechanism.

In other words, based upon a signal inputted by the specific operation, a judgment is made as to which number of packaging box 60 is related to the corresponding job, or which number of packaging box 60 is empty, and the shifting mechanism 70 is controlled accordingly. In the Figure, the inside of a wall 216 of the outlet serves as a guide, so that not less than five packaging boxes 60 are placed so as to be supplied. If the number thereof becomes not more than five, a supply signal is released. Here, the reduction of the number of the packaging boxes 60 may be visually confirmed and the corresponding supply may be carried out.

In the embodiment as shown in FIG. 10B, the packaging boxes 60 are placed so as to be directed in a diagonal direction, with the result that the eject mechanism can be omitted. In this case, when the outlet 214 is always opened, the packaging box 60, transported to the take-out level, jumps out of the outlet 214 by its own gravity; therefore, the outlet 214 is normally closed by the shutter 215, and at the time of taking out, the shutter is opened so that the packaging box 60 containing the paper W is allowed to jump outside the device by its own gravity. When the corresponding box has been taken out, the shutter 215 is closed so as to prevent the box above this from being also taken out.

Figure 11:
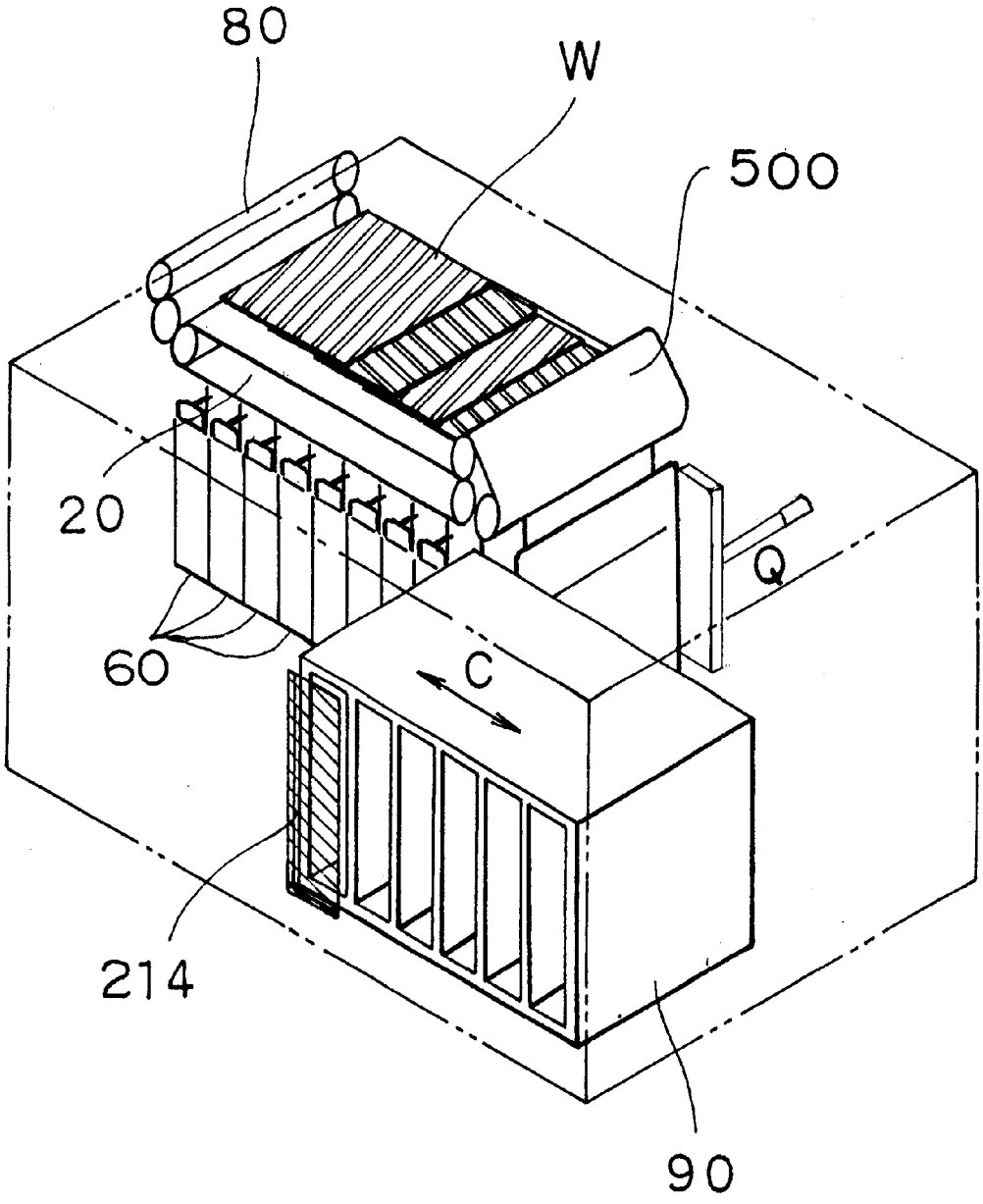
FIG. 11 is a schematic perspective view showing a fifth embodiment.
Figure 12:
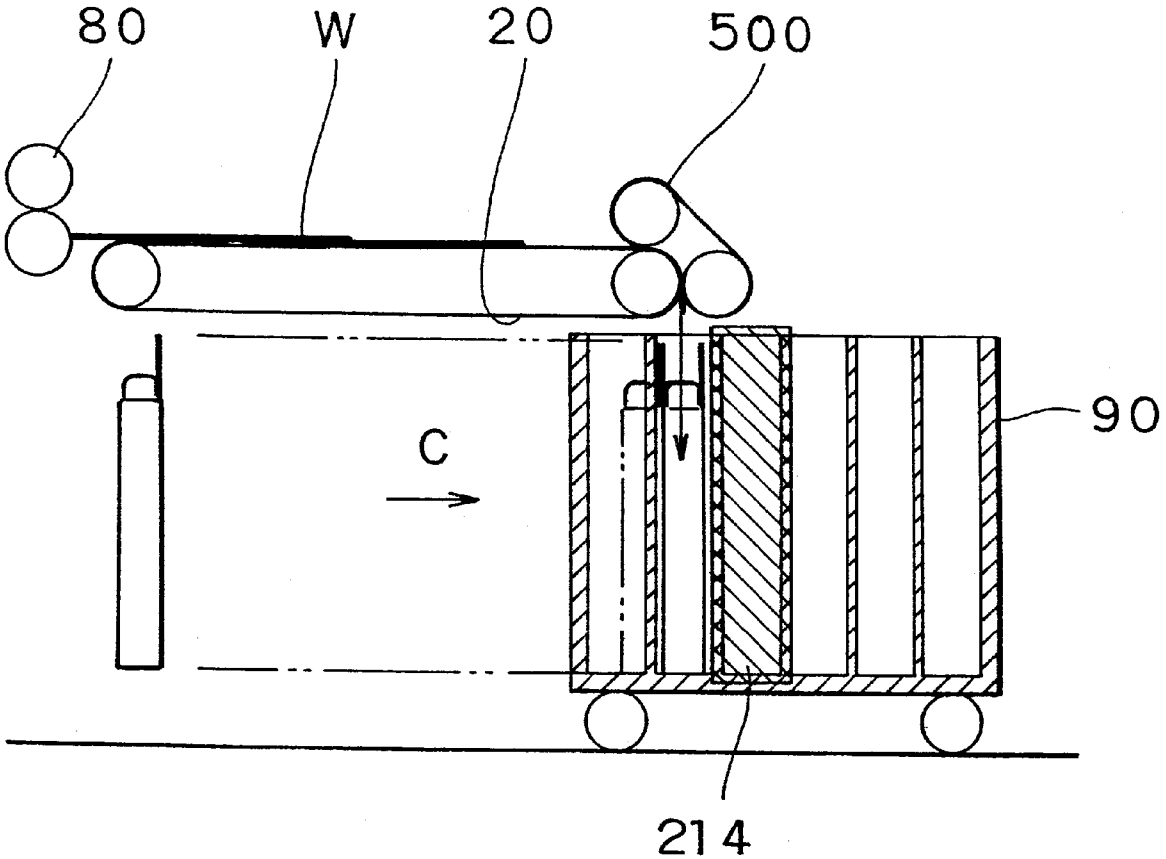
FIG. 12 is an explanatory diagram showing operations of the fifth embodiment.
Figure 13A:
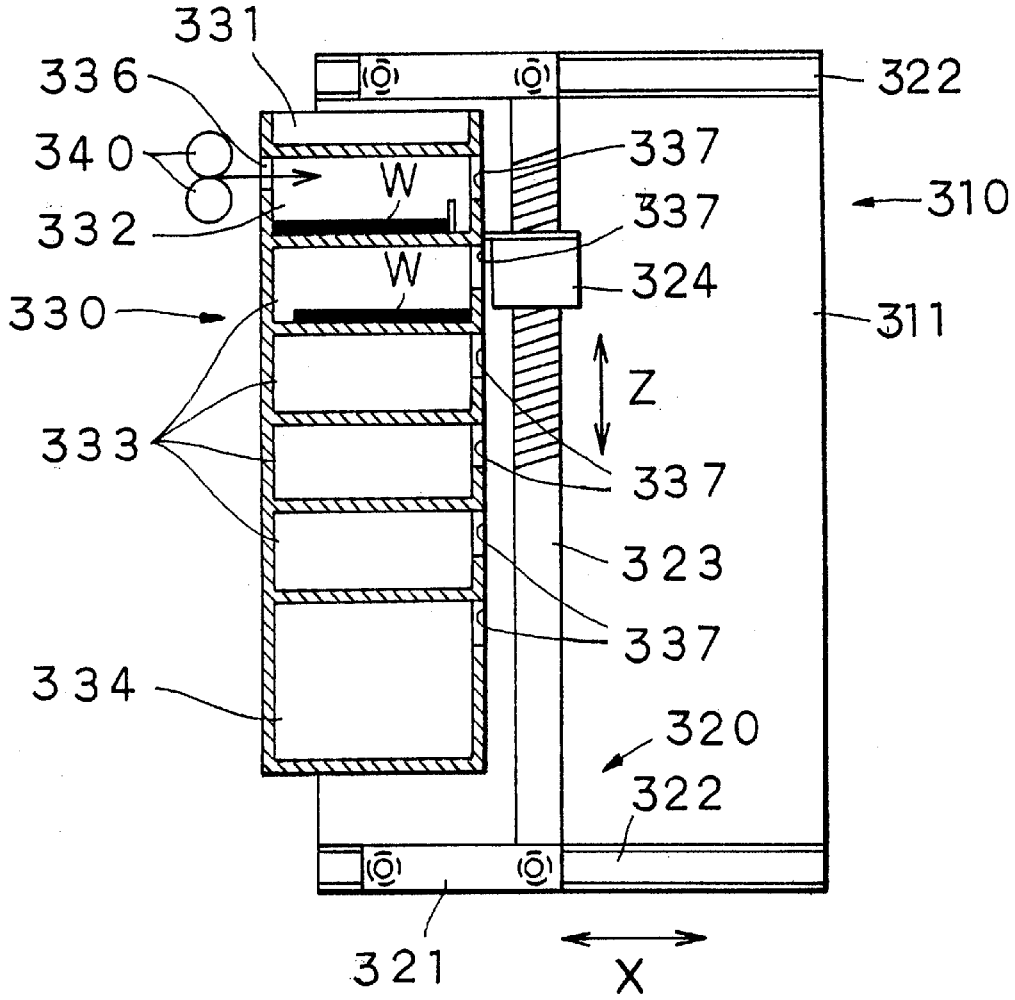
FIGS. 13A and 13B are cross-sectional side and plan views, respectively, showing a state in which a printed sheet is discharged on a paper discharge tray in a preferred embodiment of a paper storage and take-out device in accordance with the present invention.
Figure 13B:
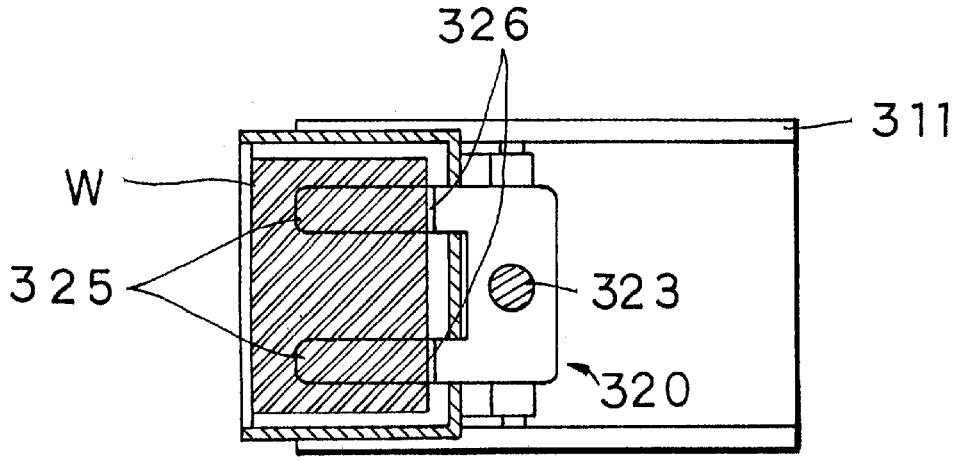

FIGS. 11 and 12 show the fifth embodiment of a sheet-processing device in accordance with the present invention. In these Figures, the same reference numbers indicate the same members or corresponding members in FIGS. 5 and 6. In this embodiment, a direction switching member 500 is installed at the rear end of the conveyor belt 20, and a plurality of packaging boxes 60 are placed side by side below the conveyor belt 20. On the side of the conveyor belt 20, a housing container (maintaining section) 90 is placed along the conveyor belt 20. The housing container 90 is separated by partition walls to provide respective spaces, each having the size of the packaging box 60; thus, the packaging boxes 60 are housed therein.

After the predetermined processes have been carried out on the paper W on the main body side, the paper W is discharged onto the conveyor belt 20 by a paper discharge roller 80, transported by the conveyor belt 20, switched downward in its direction by a direction switching member 100, and put into a packaging box 60 located below the rear end of the conveyor belt 20. At this time, it is possible to transport a plurality of sheets of paper W in an overlapped manner by delaying the paper discharging speed of the paper discharge roller 80 as compared with the transport speed of the conveyor belt 20; thus, it becomes possible to reduce the occurrence of paper jams. The length of the transport path of the paper W is not particularly limited, which makes it different from the aforementioned embodiments. Moreover, in addition of the arrangement for delaying the shifting speed of the conveyor belt 20, the shifting may be carried out intermittently. It is also effective to install a vacuum device and a pressing roller (not shown) on demand, in order to prevent disturbance of the paper W on the conveyor belt 20.

Here, the housing container 90 is shifted by a container shifting mechanism (not shown) so as to allow its empty housing space to be located at the rear end position of the conveyor belt 20, and after the paper W for one job has been put into the packaging box 60, the packaging box 60 is shifted into the empty housing space of the housing container 90 by a box-shifting pusher Q.

In the present embodiment, when the user carries out a specific operation such as an entry of a password, etc., the housing container 90 is shifted so as to allow the packaging box 60 corresponding to the specific operation to stop at the position of the outlet 214, where this is pushed outside by the above-mentioned pusher Q, thereby allowing the user to get the paper W. This arrangement makes it possible to ensure the security and also to provide easy handling. Instead of the packaging box 60, a packaging bag may be used with the same effects.

Therefore, in addition to the effects of the first embodiment, the sheet-processing device of the present embodiment provides the following effects.

1. It is possible to ensure the inserting process into the box by stacking the sheets of paper in an offset state in the trap section T.

2. It is possible to simplify the device by providing the sorter section 300 as boxes, etc.

3. It is possible to ensure the security and also to provide easy handling by providing the trap section T as boxes.

4. It is possible to ensure the security and also to provide easy handling by providing the trap section T as bags.

Additionally, the present invention is not intended to be limited by the above-mentioned embodiments, and various modifications and improvements may be made. For example, the sorter section may have a shape different from the above-mentioned embodiments, and for example, an elevator system, a rotation system, etc. may be adopted. Moreover, the transport means is not limited to the conveyor belt, and may be provided as a combined system of transport rollers, guide plates, etc.

FIGS. 13 through 22 show preferred embodiments of a paper storage and take-out device that is a sheet-processing device in accordance with the present invention. FIGS. 13A and 13B respectively show a cross-sectional side view and a cross-sectional plan view of the paper storage and take-out device of the present embodiment in a state where printed paper W is being discharged onto the paper discharge tray. In these Figures, the device 310 is constituted by a paper discharge roller (transport means) 340, a paper storage container (paper storage section) 330, a shifting mechanism (paper shifting mechanism) 320 and an operation device (controller, temporary storage section setting means, temporary storage section output setting means), not shown.

The paper discharge roller 340 is arranged to discharge printed paper W that has been subjected to predetermined processes onto the paper storage containing 330.

As illustrated in FIG. 16, the paper storage container 330 is provided with a paper take-out bin 331, placed at the uppermost stage, from which the paper W is taken out from the outside thereof , a paper discharge tray (paper discharge section) 332, located below this, which receives the discharged paper W, temporary storage bins 333 having a plurality of stages, which temporarily store the paper W discharged onto the paper discharge tray 332, and a large amount storage bin 334 for temporarily store a large amount of paper W that has been discharged, which is located at the lowermost stage. An outlet 335, which can be pulled out toward the front side, is formed in the side face of the maximum amount storage bin 334. Moreover, as illustrated in FIG. 13, the paper discharge tray 332 is provided with a paper discharge opening 336 formed in the wall face on the discharge roller 340 side, and a paper loading and sending opening 337 is formed in the wall face of the paper discharge tray 332, the temporary storage bins 333 and the maximum amount storage bin 334 on the side opposite to the paper discharge opening 336, and the paper discharge tray 332 and the temporary storage bins 333 are designed such that the paper W is not taken out from the front side of the device.

In the shifting mechanism 320, guide rails 322 are placed in a manner extending in the horizontal direction, on both of the right and left side faces of the upper end and lower end of the device frame 311; sliders 321 are supported by the guide rails 322 in a manner so as to freely slide in the X direction; a forwarding threaded bar 323 is supported between the upper and lower sliders 321 in a manner so as to stick upward; and a female screw member 324 engages the forwarding threaded bar 323; thus, the female screw member 324 is allowed to shift in the X direction and the Z direction. A fork 325, which raises paper W and allows it to shift, is attached to the female screw member 324 and a contact portion 326 is formed on the fork 325.

Moreover, a notch 338, to which the fork 325 is inserted, is formed in the lower side face of the paper loading and sending opening 337 of each of the paper take-out bin 331, the paper discharge tray 332, the temporary storage bins 333 and the maximum amount storage bin 334, and the fork 325 is normally located at the bottom of the paper discharge tray 332, and stopped at a position corresponding to the paper size in the X direction.

Each time the paper W is discharged sheet by sheet, the shifting mechanism 320 gives a motion in the X direction (in the lateral direction in the drawing of FIG. 13A) to it so that the sheets of paper W thus discharged are more positively arranged.

The operation device may be arranged so as to include, for example, a display, a key board, a CPU, a memory, etc., and the operations are given on the main body side, and the controlling operations such as the driving control of bins are given by the sheet-processing CPU 450. The sheet-processing CPU 450 controls the shifts of paper W between the paper take-out bin 331, the paper discharge tray 332, the temporary storage bins 333 and the maximum amount storage bin 334. In other words, the discharged paper W on the paper discharge tray 332 is shifted to an empty temporary storage bin 333, and after a lapse of a predetermined time since the start of the storage of the paper W in the temporary storage bin 333, the paper W is shifted to the maximum amount storage bin 334, and based upon a take-out instruction from the user, the paper W in the temporary storage bin 333 is shifted to the paper take-out bin 331.

Figure 14A:
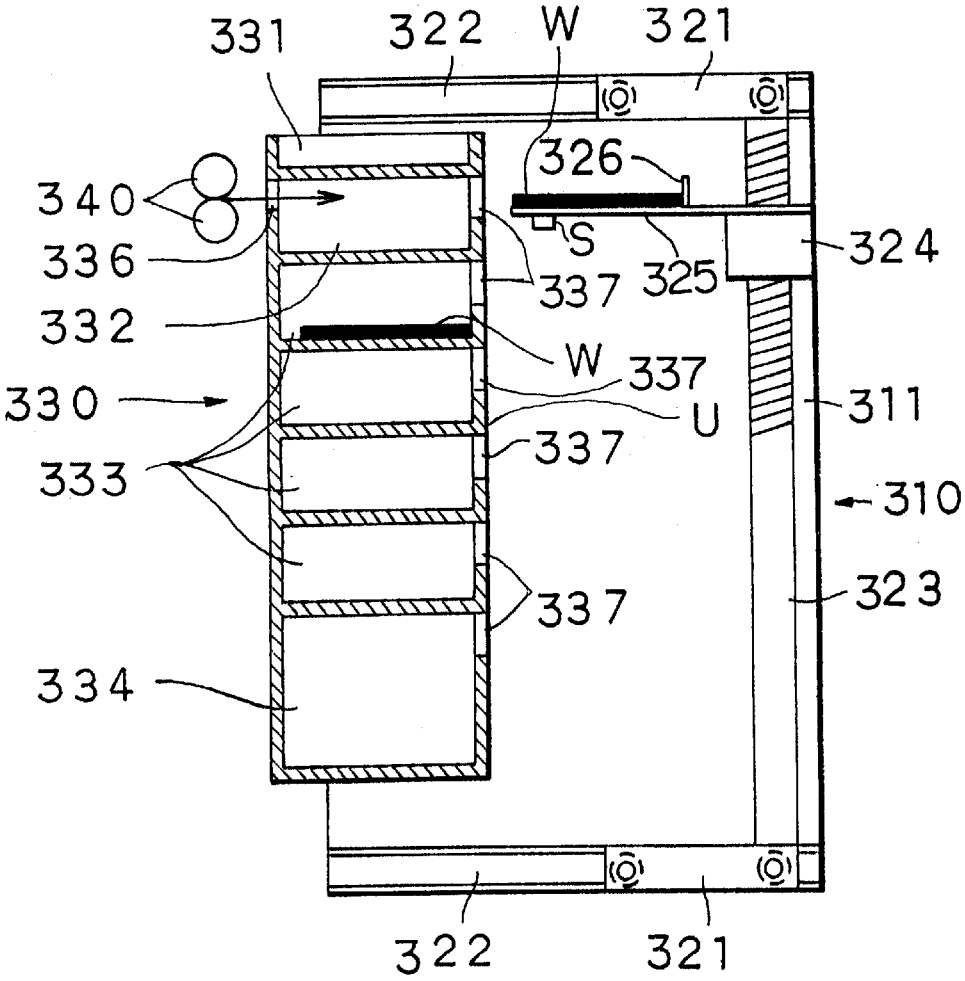
FIGS. 14A and 14B are cross-sectional side and plan views, respectively, showing a state in which the printed sheet that has been discharged is being shifted to a temporary storage bin or a maximum amount storage bin in the above-mentioned embodiment.
Figure 14B:
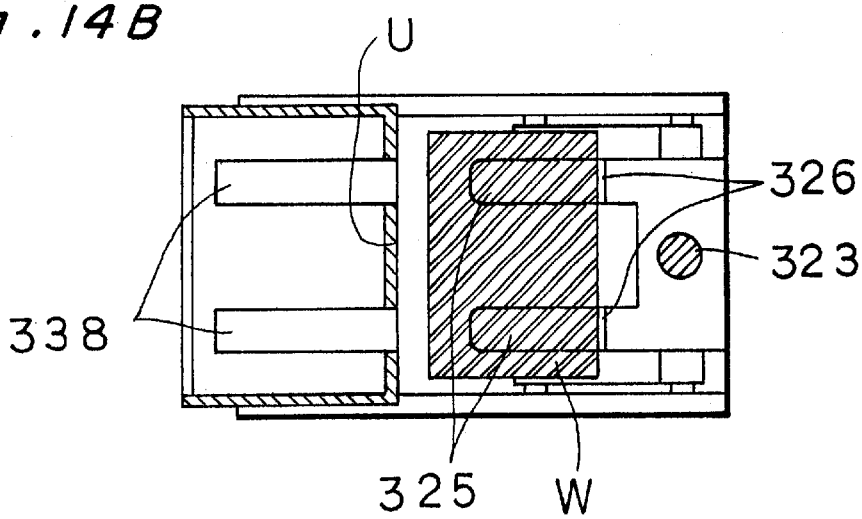

FIGS. 14A and 14B respectively show a cross-sectional side view and a cross-sectional plan view that show a state in which, after completion of one job, the paper W is being transported to a specific temporary storage bin or the maximum amount storage bin 334, other than the paper discharge tray 332.

FIG. 15 schematically shows a process in which the paper W is transported to a specific bin from the paper discharge tray 332. Here, for convenience of explanation, the paper storage container 330 is constituted by the three stages of the paper take-out bin 331, the paper discharge tray 332 and the temporary storage bin 333.

Figure 15A:
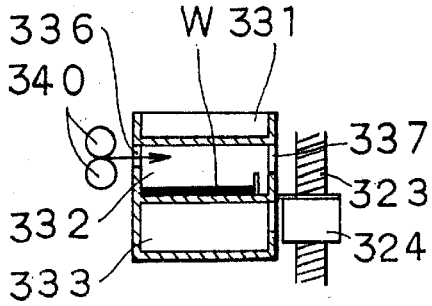
FIGS. 15A, 15B, 15C, 15D, 15E, 15F and 15G are schematic diagrams showing respective processes from a printed sheet discharge to the storage thereof in the above-mentioned embodiment.

FIG. 15A shows a state in which the paper W, which has been subjected to a predetermined processes, is discharged onto the paper discharge tray 332 through the paper discharge opening 336 by the paper discharge roller 340, and stacked on the bottom of the paper discharge tray 332. In this case, the fork 325 is stopped at a position corresponding to the paper size in the X direction of the bottom of the paper discharge tray 332; therefore, the discharged sheets of paper W are positioned by the contact portion 326, and stacked on the fork 325. After the sheets of paper W have been discharged, the forwarding threaded bar 323 of the shifting mechanism 320 is allowed to rotate so that the female screw 324 is raised, and as illustrated in FIG. 15B, the stacked paper W is raised upward (in the Z direction) inside the paper discharge tray 332. In this case, since the amount of shift is constant, it is possible to easily control this operation.

When the paper W has been raised to the level of the paper loading and sending opening 337, the slider 321 is allowed to retreat, with the result that the fork 325 is externally withdrawn from the paper loading and sending opening 337 of the paper discharge tray 332. FIG. 15C shows the above-mentioned state. When the paper W has been pulled out of the paper discharge tray 332, the forwarding threaded bar 323 of the shifting mechanism 320 is rotated and the female member 324 is shifted downward (Z direction) as shown in FIG. 15D, so as to shift the paper W to a predetermined temporary storage bin 333.

Figure 15E:
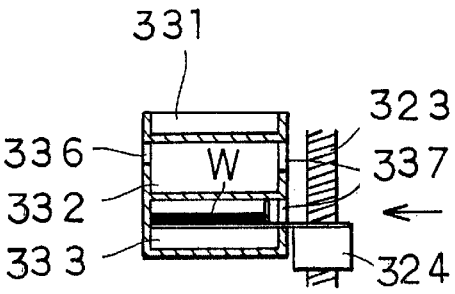
Figure 15B:
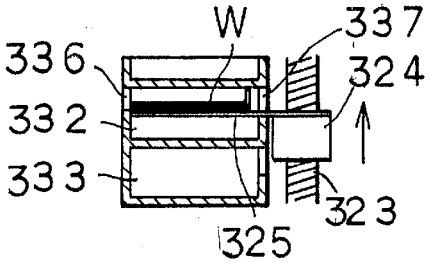
Figure 15F:
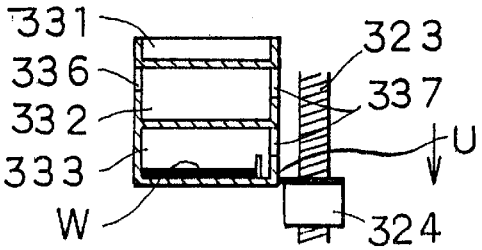
Figure 15C:
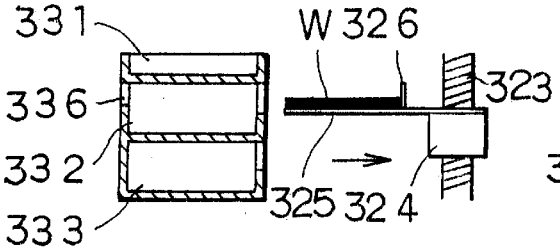
Figure 15G:
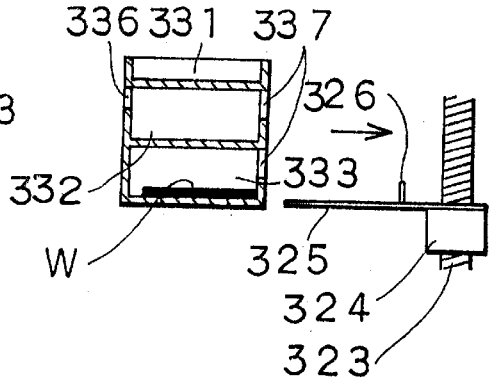
Figure 15D:
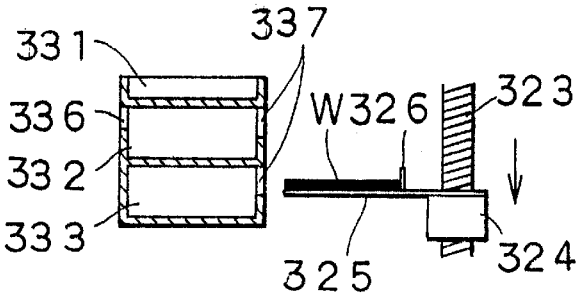

When the paper W is shifted to the position of the paper loading and sending opening 337 of the temporary storage bin 333 in which it is stored, the slider 321 is allowed to advance so as to store the paper W in the temporary storage bin 333 as illustrated in FIG. 15E, and when the fork 325 comes to a predetermined position, the forwarding threaded bar 323 is rotated so as to lower the fork 325 to the bottom of the temporary storage bin 333, as illustrated in FIG. 15F, and at last, as illustrated in FIG. 15G, the slider 321 is allowed to retreat so that the paper W on the fork 325 is regulated by the wall face U of the paper loading and sending opening 337 so as not to shift outward, and is stored into the temporary storage bin 333.

In accordance with the above-mentioned sequence of processes, the paper W is shifted from the paper discharge tray 332 to a desired temporary storage bin 333, and in accordance with similar sequences, the paper W can be shifted from the paper discharge tray 332 to the paper take-out bin 331, as well as from the temporary storage bin 333 to the paper take-out bin 331.

With respect to the maximum amount storage bin 334, the amount of shift of the fork 325 in an up and down direction shown in FIGS. 15E and 15F is not constant, and it is necessary to change the amount of shift depending on the level of the paper W stored therein. For this reason, a sensor S (FIG. 14) for detecting the upper face of the paper W is attached to the fork 325. In other words, the fork 325 is arranged so that it is allowed to descend until the sensor S has detected the upper face of the paper W or the upper face of the bottom of the maximum amount storage bin 334, if it is empty. Here, the sensor S is not necessarily attached to the fork 325, and may be installed on the maximum amount storage bin 334. Alternatively, since the amount of stacked paper W for one job is detected by counting the number of the output sheets, the amount of descent of the fork 325 may be controlled based upon this detection.

FIG. 16 is a schematic perspective view that shows a specific construction of the paper storage container 130. In this Figure, the paper take-out bin 331 is located at the uppermost stage, the paper discharge tray 332 is located at the second stage, and the paper W, discharged by the paper discharge roller 340, is allowed to enter the paper discharge tray 332 through the paper outlet.

Four stages of the temporary storage bins 333 are prepared, and normally, the paper W is housed in the temporary storage bin 333 from the paper discharge tray 332, and upon receipt of a specific operation, such as an entry of a password, etc., the corresponding paper W in the temporary storage bin 333 is shifted to the paper take-out bin 331. With respect to the maximum. amount storage bin 334 at the uppermost stage, it is arranged so that the outlet 335 can be opened or closed by entering a specific code; thus, for example, only the managing person is allowed to take out the paper W from the outlet 335.

Figure 16A:
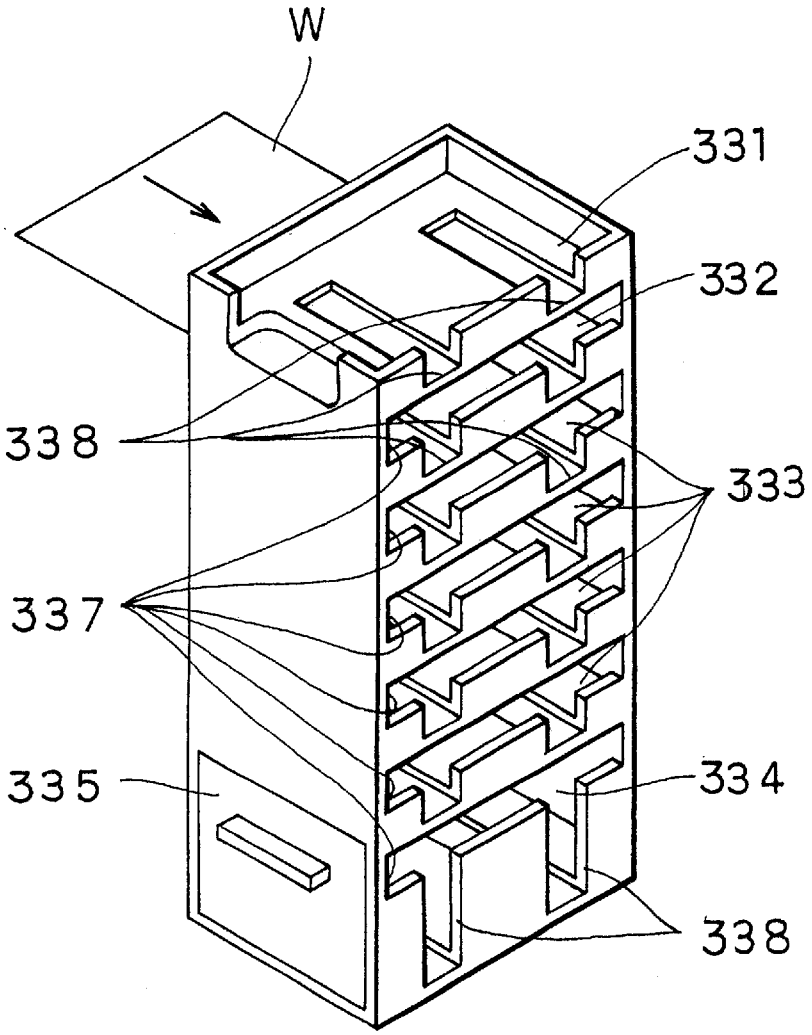
FIG. 16A is a perspective view showing a paper storage container in the above-mentioned embodiment.
Figure 16B:
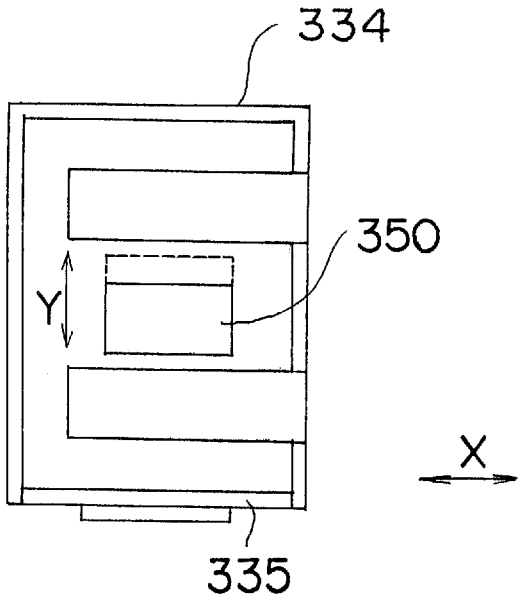
FIG. 16B is a cross sectional view showing a job-offset mechanism in the above-mentioned embodiment.

Here, as illustrated in FIG. 16B, a bottom plate 350, provided with a shifting mechanism in the Y direction, is installed in the bottom of the maximum amount storage bin 334. Each time paper W is put into the maximum amount storage bin, the bottom plate 350 is switched between a solid-line position and a dashed-line position so that a sorting process is carried out. As illustrated in FIG. 16A, the bin bottom is formed into a concave shape so that a fork 125 is inserted therein even when the paper W is stacked thereon. This arrangement makes it possible to freely load and unload the respective bins 131 to 134 with the paper W.

Moreover, instead of forming the bottom into the concave shape, an opening (or a hole) may be formed in the bin bottom, and all the bin bottoms may be formed into this shape. This arrangement makes it possible to allow the fork 325 to be inserted and withdrawn therein and therefrom at any timing; therefore, even when the fork 325 is not located at the initial position inside the paper discharge tray 332, it is not necessary to stop the discharging process of the paper W, and the fork 325 is inserted into the paper discharge tray 332 with the sheets of paper W stacked to a certain extent in the paper discharge tray 332, and the sheets of paper W are arranged and transported.

Figure 17:
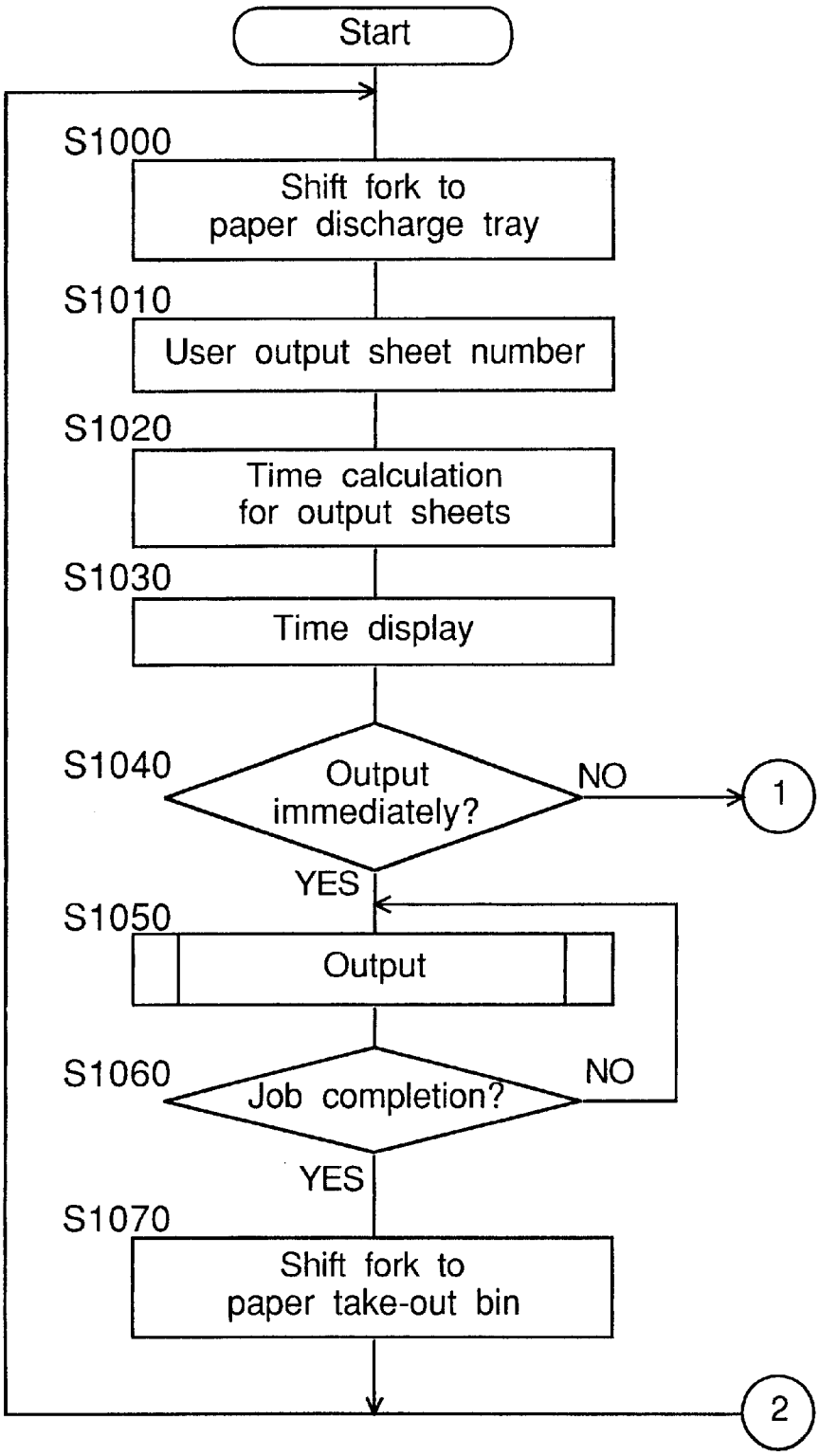
FIG. 17 shows a portion of a flowchart indicating a print shifting process in the above-mentioned embodiment.
Figure 18:
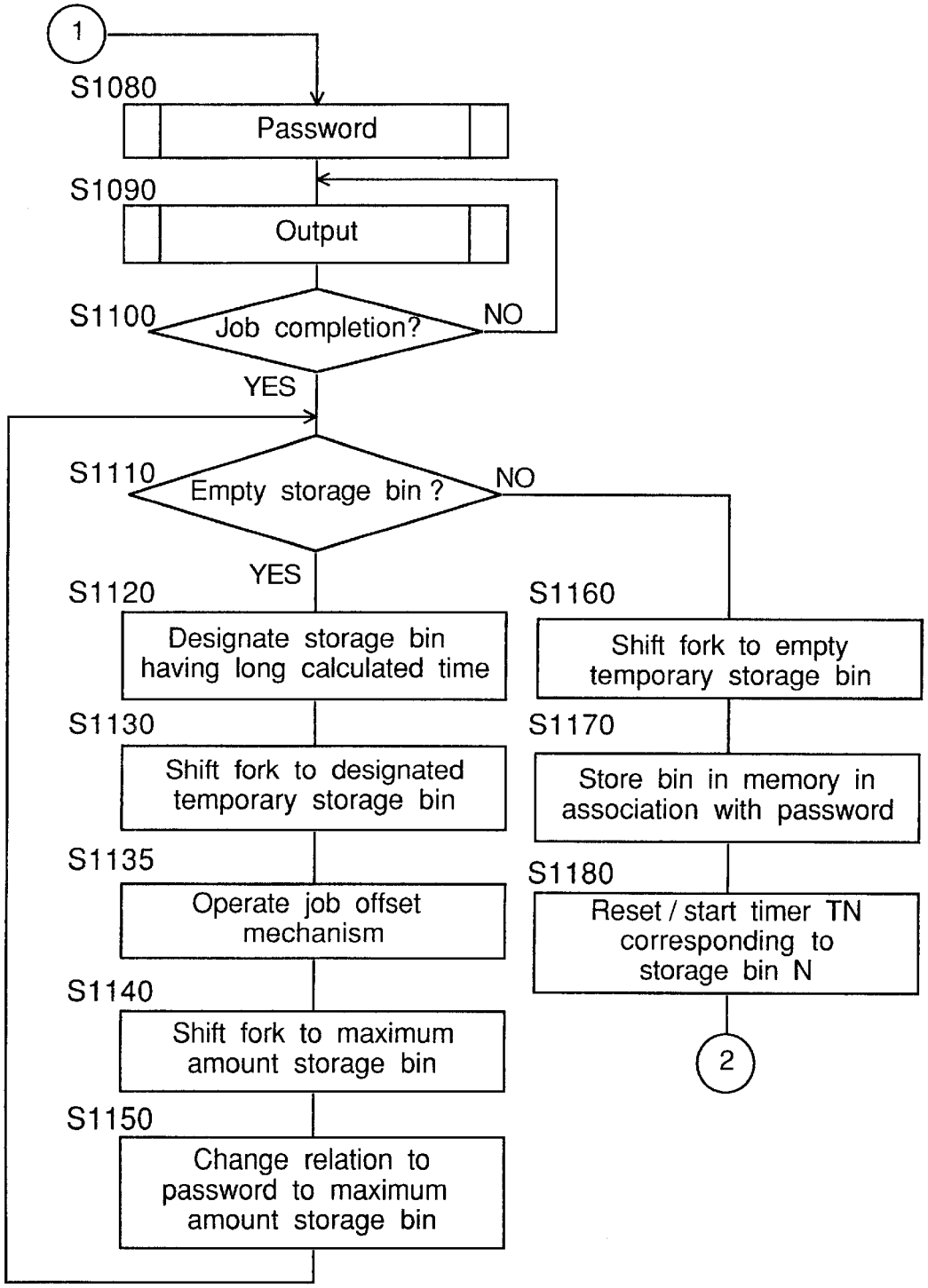
FIG. 18 shows the rest of the flowchart shown in FIG. 17.
Figure 19:
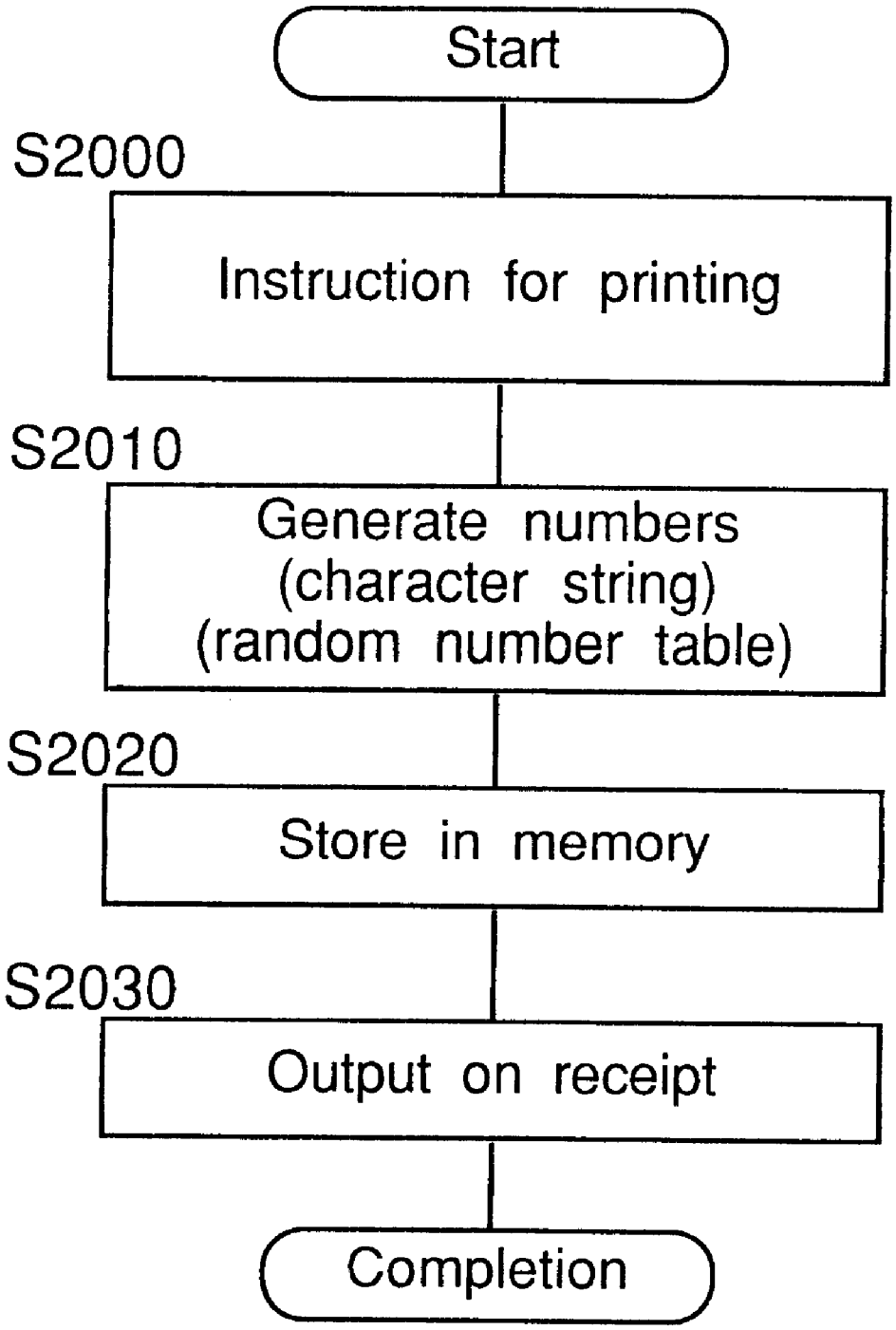
FIG. 19 is a flowchart indicating a setting process of a password.

Next, referring to flowcharts in FIGS. 17 and 18, an explanation will be given of a sequence in which the printed sheets of paper W are taken out or shifted into the temporary storage bin 333 or the maximum amount storage bin 334. Upon starting the processes, the fork 325 is shifted to the paper discharge tray 332, that is, to its initial position (step S1000). When the user specifies the number of output sheets by operating the operation device of the image output apparatus (step S1010), the time required for the printing process is calculated from the number of output sheets (step S1020), and the calculated printing time is displayed on a display, etc. of the operation device (step S1030). At this time, the time required for jobs that have been reserved and have not yet been done is also added to the time, and displayed. For example, in the case when the job, which was reserved and is being currently printed, takes 10 minutes, and when the present job to be set takes 20 minutes, the time "30 minutes" is displayed on the display, etc. Based upon the results of the display, the user can determine whether the job is "outputted right now" or "outputted later".

In the case when the user determines to "output right now", the outputting processes including the control of printing processes are carried out (step S1050), a judgment is made as to whether or not the necessary job has been finished (step S1060), and if the necessary job has been finished, the fork 325 is shifted from the paper discharge tray 332 to the paper take-out bin 331, thereby allowing the user to take the paper W out immediately.

In the case when the user's setting is to "output later", a password is first set (step S1080). Referring to a flowchart shown in FIG. 19, this setting process is explained in detail: When the user gives an instruction for printing (step S2000), a password containing numbers and characters is generated by using random numbers, etc. (step S2010), and this is stored in the memory 412, and also printed on a receipt (see FIG. 4), and outputted outside the device (steps S2020, S2030), thereby completing the setting of the password.

Here, the password thus generated, the current time and the status (in use/empty) of the temporary storage bin 333 are written in the memory 412, and at this time, the address of the memory 412 corresponds to the temporary storage bin 333 so that an empty bin is selected based upon the contents of the memory 412, and the generated password is written in and a flag indicating "in-use" is placed. When the password printed on the receipt is inputted by the user in order to take out the printed sheets of paper W, this is compared with the contents of the memory 412, and if both of these are coincident with each other, the paper W in the corresponding temporary storage bin 333 is taken out; thus, the contents of the memory is cleared. Here, FIG. 20 shows one example of a list indicating the relationship between the bin numbers and the addresses. The bin No. 6 represents the maximum amount storage bin, and in this case, since there are four jobs, four address codes are set.

Upon completion of setting of the password, the outputting processes including the control of printing processes are carried out (step S1090), a judgment is made as to whether or not the necessary job has been finished 30 (step S1100), and if the necessary job has been finished, a judgment is made as to whether or not an empty bin exists among the temporary storage bins 333 (step S1110), and if there is any empty bin, the fork 325 is shifted to the empty temporary storage bin 333, and the paper W is stored in the temporary storage bin 333 (step S1160); thus, this temporary storage bin 333 and the set. password are stored in the memory 412 in association with each other (step S1170).

Next, after resetting a timer TN corresponding to the temporary storage bin N stored in the memory 412, the sequence is started (step S1180), and the sequence returns to the first process (step S1000) so that the processes are repeated. When, after a lapse of a predetermined time, the paper W has not been taken out, the paper W is shifted from the temporary storage bin N to the maximum amount storage bin 334 in accordance with the timer TN. Here, a detailed description thereof will be described later.

In contrast, in the case when no empty storage bin 333 exists (No, in step S1110), based upon the counted time of the timer TN, the temporary storage bin N related to the timer N having the longest counted time, that is, the temporary storage bin N which has stored the paper W for the longest time, is designated (step S1120), and the fork 325 is shifted to the corresponding temporary storage bin N (step S1130), and after a JOB offset is carried out (step S1135) so as to sort the sheets of paper W to be stored in the maximum amount storage bin 334, the stored paper W is taken out by the fork 325, and shifted to the maximum amount storage bin 334 and stored therein (step S1140). After the contents of the temporary storage bin N that have been made to correspond to the password are changed to those corresponding to the maximum amount storage bin 334 (step S1150), the sequence returns to the judging process as to whether or not any empty bin exists among the temporary storage bins 333 (step S110), thereby repeating the above-mentioned processes.

Figure 21:
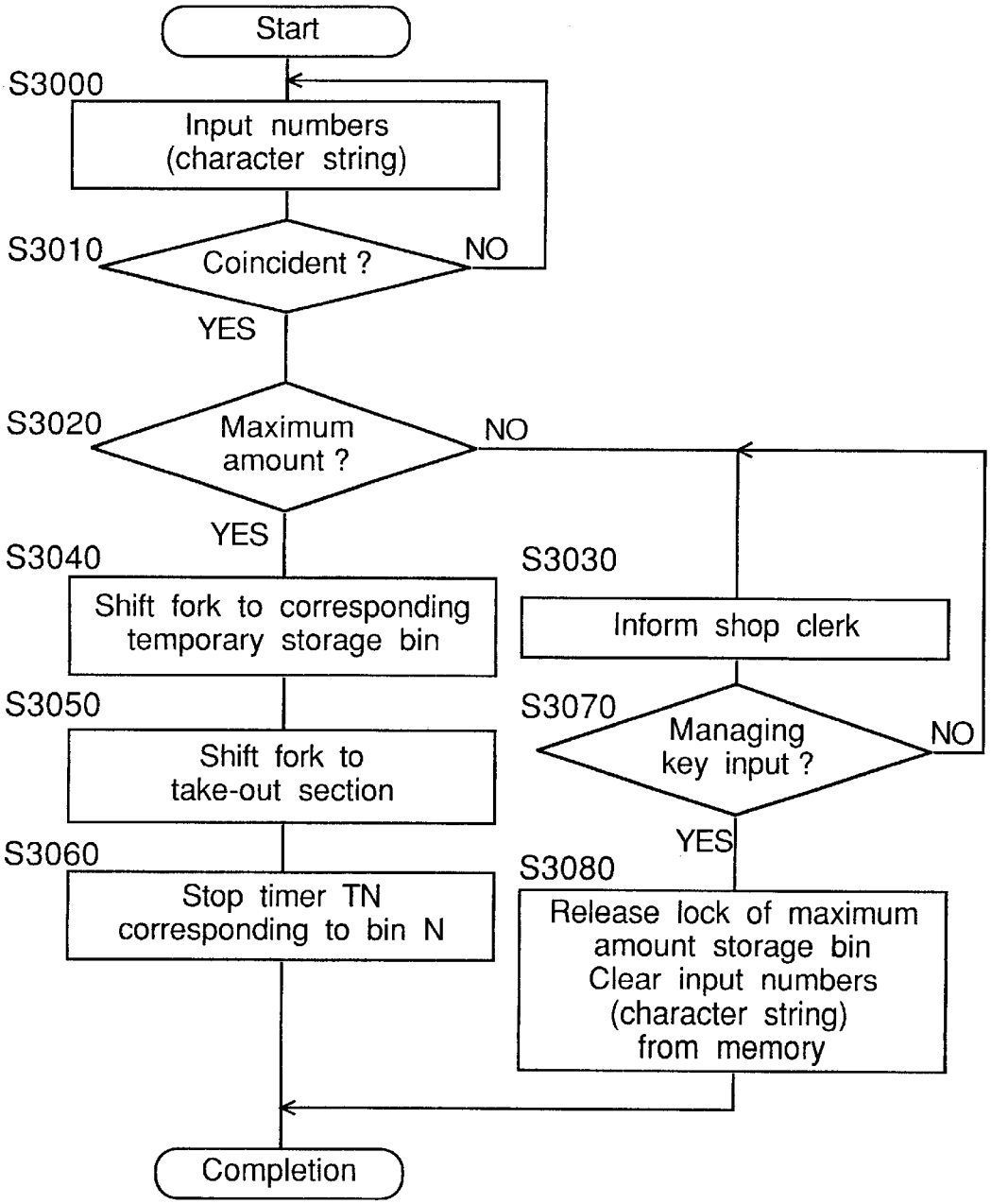
FIG. 21 is a flowchart indicating a print take-out process.

FIG. 21 shows a flowchart indicating a controlling process at the time of taking out the print. When, upon starting the process, the user inputs a password (numbers and a character string) printed on a receipt to the operation device (step S3000), a judgment is made as to whether or not the password is coincident with the contents stored in the memory (step S3010), and if this is coincident, a judgment is made as to whether or not the bin corresponding to the password is a maximum amount storage bin 334 (step S3020). In the case of the maximum amount storage bin 334, a message saying "inform the shop clerk" is given on the display of the operation device (step S3030). Successively, when the shop clerk releases the lock of the outlet 335 of the maximum amount storage bin 334 by a managing key entry (step S3070), the user is allowed to take out the paper W that has been stored. At this time, the inputted password (numbers (character string)) is cleared from the memory (step S3080).

In contrast, when the bin corresponding to the password is not a maximum amount storage bin 334, the temporary storage bin 333 corresponding to the password is designated, and the fork 325 is shifted to the temporary storage bin 333, the paper W inside the temporary storage bin 333 is taken out (step S3040), and shifted to the paper take-out bin 331 (step S3050), and the timer TN corresponding to the temporary storage bin 333 is stopped and reset (step S3060), thereby completing the processes.

Figure 22:
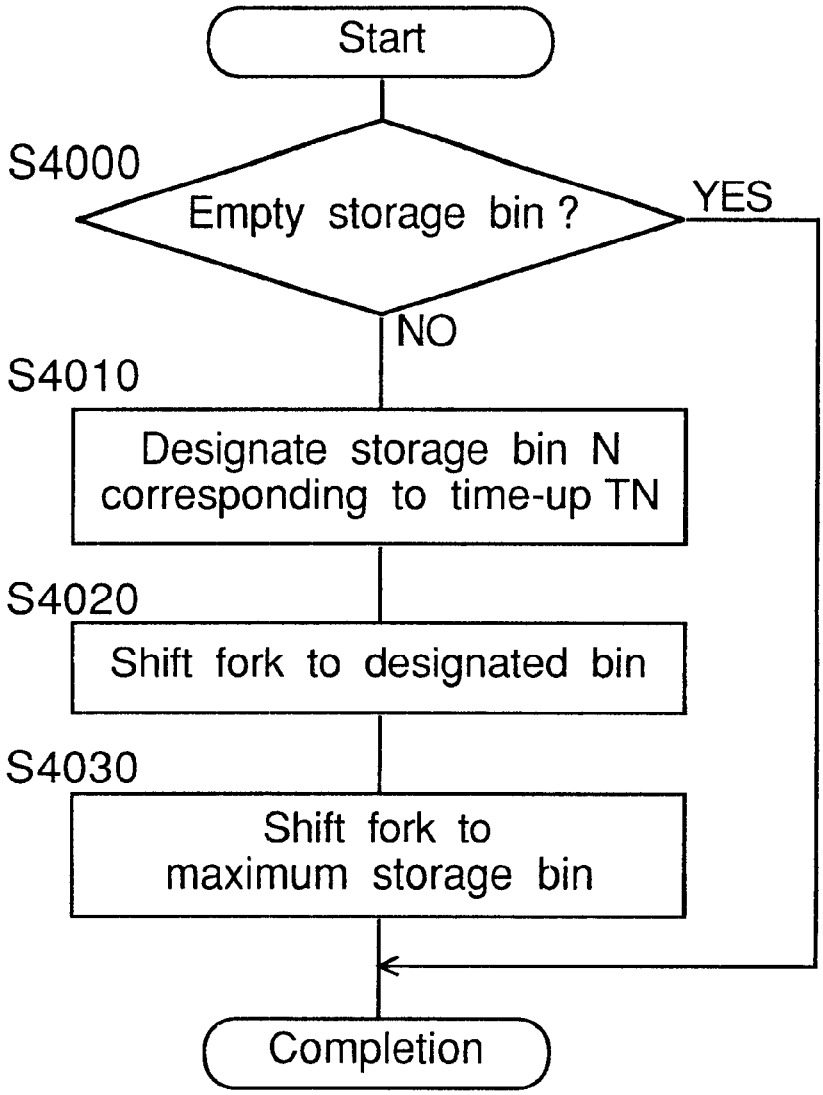
FIG. 22 is a flowchart indicating a timer interrupt process.

Next, referring to a flowchart in FIG. 22, an explanation will be given of an interrupt controlling process by the timer TN. If, among a plurality of timers, one has a lapse of a predetermined time, for example, a lapse of one hour, the interrupt controlling process is executed. When the process is started, a judgment is made as to whether or not an empty bin exists (step S4000), and if there is any empty bin, the process is completed. If no empty bin exists, the temporary storage bin N corresponding to the timer TN that has timed up is designated (step S4010), and after the fork 325 has been shifted to the designated temporary storage bin N (step S4020), the fork 325 is shifted to the maximum amount storage bin 334 so as to transfer the paper W that has been stored in the designated temporary storage bin N to the maximum amount storage bin 334, thereby completing the process.

Figure 23:
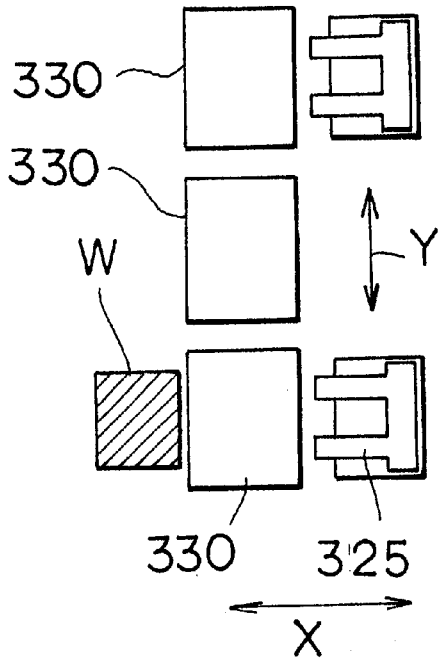
FIG. 23 is an explanatory plan view showing another embodiment of the sheet storage and take-out device of the present invention.

FIG. 23 shows an example of an X, Y and Z three-dimensional driving mechanism (which may be formed by a conventional mechanism, although not particularly shown) in which, for example, three rows of paper storage containers 330 are aligned side by side in the Y direction, and the fork 325 is also allowed to shift in the Y direction. In this case, it is possible to increase the processing capacity to a great degree, and also to improve the degree of freedom in determining the take-out position.

Figure 24:
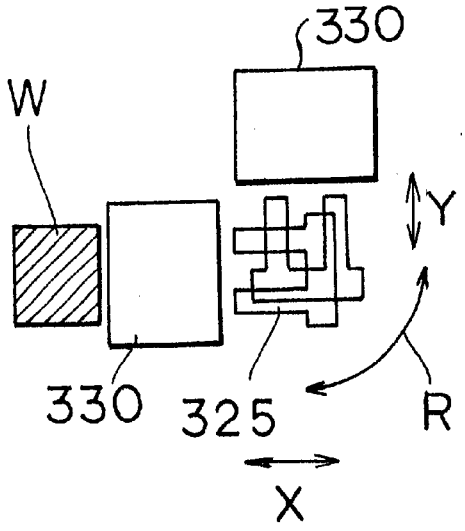
FIG. 24 is an explanatory plan view showing still another embodiment of the sheet storage and take-out device of the present invention.

FIG. 24 shows an embodiment in which, in addition to the X, Y and Z three-dimensional driving mechanism, the fork 325 is supported by a rotating mechanism (which may be made by a conventional mechanism, although not particularly shown), and a second paper storage container 330 is placed at a position having a 900 difference from the first paper storage container 330 to which the paper W is discharged. In this case, the paper W, received from the first row of bins, is transferred to the second row of bins by utilizing the 90° rotation of the fork 325 (R in the Figure) and the shift in the Y direction. In this case also, the same effects as those of the embodiment shown in FIG. 23 are obtained.

Figure 25:
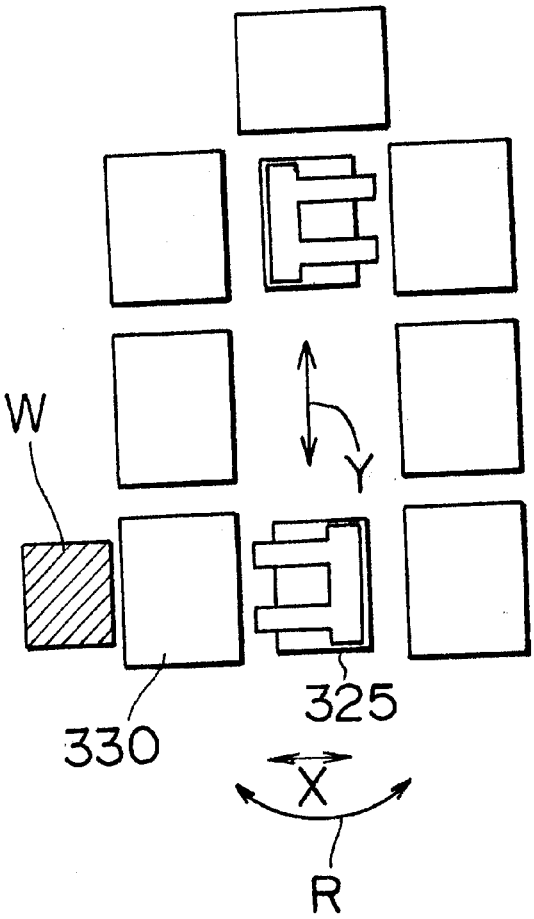
FIG. 25 is an explanatory plan view that shows the other embodiment of the sheet storage and take-out device of the present invention.

FIG. 25 shows an embodiment in which seven paper storage containers 330 are arranged in a reversed U-letter shape, and the fork 325 is supported by the X, Y and Z three-dimensional driving mechanism and the rotating mechanism so that paper is maintained in the seven paper storage containers 330; thus, it is possible to greatly increase the processing capacity.

What is claimed is:

1. A print system comprising:

a print unit for making a print on a sheet;

first control means for allowing a printing process by the print unit upon receipt of a predetermined fare;

second control means for allowing a take-out process for at least one printed sheet upon entry of predetermined coded information; and a receipt output device for outputting a receipt on which the fare and the predetermined coded information are printed.

2. The print system according to claim 1, further comprising a sheet-processing device having a plurality of bins for containing at least one sheet sorted for each of jobs; and a memory for storing the coded information in association with the number of each bin, wherein the second control means allows the at least one sheet to be taken out from the bin corresponding to the input code information.

3. The print system according to claim 1, further comprising a third control means for inhibiting the take-out process for the at least one sheet after a lapse of a predetermined time since the last printing process.

4. The print system according to claim 3, further comprising a display for displaying the fact that the take-out process has been inhibited.

5. The print system according to claim 3, further comprising a releasing means for allowing a manager to release the inhibited state by the third control means.

* * * * *